US008851362B2

(12) United States Patent
Aksan et al.

(10) Patent No.: US 8,851,362 B2
(45) Date of Patent: Oct. 7, 2014

(54) PACKING CONTAINER

(75) Inventors: Yavuz Aksan, Suwanee, GA (US); Ernest Barfield Widner, Gainesville, GA (US); Wayne P. Gasior, Duluth, GA (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 136 days.

(21) Appl. No.: 13/224,734

(22) Filed: Sep. 2, 2011

(65) Prior Publication Data

US 2012/0055922 A1 Mar. 8, 2012

Related U.S. Application Data

(60) Provisional application No. 61/379,808, filed on Sep. 3, 2010.

(51) Int. Cl.

| | |
|---|---|
| ***B65D 5/42*** | (2006.01) |
| ***B65D 5/44*** | (2006.01) |
| ***B65D 5/02*** | (2006.01) |

(52) U.S. Cl.

CPC ..... *B65D 5/0227* (2013.01); *B65D 5/443* (2013.01); *B65D 5/4266* (2013.01)

USPC ..... 229/198.2; 229/120

(58) Field of Classification Search

USPC ..... 229/100, 198.2, 120, 915, 918, 219; 206/6, 509; 220/6

See application file for complete search history.

(56) References Cited

U.S. PATENT DOCUMENTS

| | | | |
|---|---|---|---|
| 272,327 | A | 2/1883 | Rogers |
| 981,993 | A | 1/1911 | Gair et al. |
| 1,892,594 | A | 12/1932 | Stone |
| 2,082,365 | A | 6/1937 | Straw et al. |

(Continued)

FOREIGN PATENT DOCUMENTS

| | | | |
|---|---|---|---|
| DE | 1281342 | B | 10/1968 |
| DE | 3222017 | A1 | 12/1983 |

(Continued)

OTHER PUBLICATIONS

Machine Translation of DE1281342.

(Continued)

*Primary Examiner* — Justin Larson
*Assistant Examiner* — Phillip Schmidt
(74) *Attorney, Agent, or Firm* — William W. Letson

(57) ABSTRACT

A container includes a plurality of panels integrally arranged with respect to each other and with respect to a set of orthogonal x, y and z axes, the z-axis defining a direction line in which the container is configured to support a stacking load. The plurality of panels include a first panel having a first planar surface, and a second panel having a second planar surface, wherein the first panel and the second panel form a contiguity with a fold line disposed therebetween, and wherein the first planar surface is disposed parallel to the x-z plane or the y-z plane. The container further includes a compression reinforcement feature having a planar edge oriented orthogonal to the first planar surface and perpendicular to the z-axis, the planar edge being disposed a distance away from the fold line but at a distance no greater than half a thickness of the first panel, the first panel having a void between the fold line and the planar edge.

45 Claims, 15 Drawing Sheets

(56) References Cited

U.S. PATENT DOCUMENTS

| | | | | | |
|---|---|---|---|---|---|
| 2,114,052 | A | | 4/1938 | Kincade, Jr. | |
| 2,300,492 | A | | 11/1942 | Fischer | |
| 2,346,488 | A | | 4/1944 | Hoffmaster et al. | |
| 2,367,717 | A | | 1/1945 | Davidson | |
| 2,547,892 | A | | 4/1951 | Stevens | |
| 2,857,090 | A | | 10/1958 | Fallert | |
| 2,887,389 | A | | 5/1959 | Linville | |
| 2,962,202 | A | | 11/1960 | Hansen | |
| 3,017,064 | A | | 1/1962 | Davis | |
| 3,100,072 | A | | 8/1963 | Mason | |
| 3,163,344 | A | * | 12/1964 | Tunick | 229/120 |
| 3,164,316 | A | | 1/1965 | Wurster et al. | |
| 3,202,339 | A | | 8/1965 | Franklin, Jr. | |
| 3,206,099 | A | | 9/1965 | Fanter et al. | |
| 3,217,924 | A | | 11/1965 | Chidsey, Jr. | |
| 3,265,285 | A | | 8/1966 | Fanter | |
| 3,309,005 | A | | 3/1967 | Pilger | |
| 3,353,740 | A | | 11/1967 | Outwater | |
| 3,447,735 | A | | 6/1969 | Whitney | |
| 3,481,527 | A | | 12/1969 | Jacke | |
| 3,552,633 | A | | 1/1971 | Ketler | |
| 3,688,972 | A | | 9/1972 | Mahon | |
| 3,698,548 | A | | 10/1972 | Stenzel et al. | |
| 3,747,801 | A | | 7/1973 | Graser | |
| 3,826,421 | A | | 7/1974 | Morse et al. | |
| 3,883,067 | A | | 5/1975 | McGlynn et al. | |
| 3,899,123 | A | | 8/1975 | Stollberg et al. | |
| 3,963,170 | A | * | 6/1976 | Wood | 206/434 |
| 4,029,207 | A | | 6/1977 | Gordon | |
| 4,056,223 | A | | 11/1977 | Williams | |
| 4,084,693 | A | | 4/1978 | Culpepper | |
| 4,093,116 | A | * | 6/1978 | Watkins et al. | 229/198.2 |
| 4,256,226 | A | | 3/1981 | Stone | |
| 4,267,959 | A | | 5/1981 | Gilbert | |
| 4,283,001 | A | | 8/1981 | Meyers | |
| 4,702,407 | A | | 10/1987 | Lisiecki | |
| 4,771,939 | A | | 9/1988 | Wilkins | |
| 4,850,527 | A | | 7/1989 | Church et al. | |
| 5,002,224 | A | | 3/1991 | Muise | |
| 5,085,367 | A | | 2/1992 | Carstens | |
| 5,117,973 | A | | 6/1992 | LoDuca | |
| D337,270 | S | | 7/1993 | Brockman | |
| 5,323,957 | A | | 6/1994 | Roosa | |
| 5,335,844 | A | | 8/1994 | Young | |
| 5,400,955 | A | | 3/1995 | Coalier et al. | |
| 5,427,242 | A | | 6/1995 | Oliff et al. | |
| 5,474,232 | A | | 12/1995 | Ljunstrom et al. | |
| 5,535,941 | A | | 7/1996 | Garza | |
| 5,662,508 | A | | 9/1997 | Smith | |
| 5,671,883 | A | | 9/1997 | Philips | |
| 5,690,601 | A | | 11/1997 | Cummings et al. | |
| 5,755,377 | A | | 5/1998 | Durand | |
| 5,772,110 | A | | 6/1998 | Garretson | |
| 5,839,650 | A | | 11/1998 | Sheffer | |
| 5,918,801 | A | | 7/1999 | Milio | |
| 5,950,912 | A | | 9/1999 | Economopoulos | |
| 5,957,294 | A | | 9/1999 | Kanter | |
| 6,098,874 | A | | 8/2000 | Tokarski | |
| 6,132,349 | A | | 10/2000 | Yokoyama | |
| 6,640,975 | B2 | | 11/2003 | Bennett et al. | |
| 6,834,793 | B2 | | 12/2004 | Sutherland | |
| 6,866,186 | B2 | | 3/2005 | Fogle et al. | |
| 6,935,504 | B2 | | 8/2005 | Ritter et al. | |
| 7,124,890 | B2 | * | 10/2006 | McLeod et al. | 206/509 |
| 7,201,714 | B2 | | 4/2007 | Zoeckler et al. | |
| 7,261,231 | B2 | | 8/2007 | Kuhn et al. | |
| 7,628,311 | B2 | | 12/2009 | Kuhn et al. | |
| 7,766,219 | B2 | | 8/2010 | Gomes et al. | |
| 2002/0008134 | A1 | * | 1/2002 | Southwell | 229/166 |
| 2003/0234285 | A1 | | 12/2003 | Bates et al. | |
| 2005/0189405 | A1 | | 9/2005 | Gomes et al. | |
| 2005/0236466 | A1 | * | 10/2005 | McLeod | 229/143 |
| 2005/0279815 | A1 | * | 12/2005 | Fogle et al. | 229/103.2 |
| 2007/0000986 | A1 | | 1/2007 | McClure | |
| 2007/0063005 | A1 | | 3/2007 | Gomes et al. | |
| 2007/0138244 | A1 | * | 6/2007 | England | 229/125.32 |
| 2009/0095799 | A1 | | 4/2009 | Garner | |
| 2009/0121003 | A1 | | 5/2009 | Garner | |
| 2009/0121006 | A1 | | 5/2009 | Gasior | |
| 2010/0219232 | A1 | * | 9/2010 | Smith | 229/108 |
| 2011/0204127 | A1 | | 8/2011 | Brundage et al. | |
| 2011/0204131 | A1 | | 8/2011 | Brundage et al. | |
| 2011/0281705 | A1 | | 11/2011 | Aganovic et al. | |
| 2012/0000973 | A1 | | 1/2012 | McLeod | |
| 2012/0061456 | A1 | | 3/2012 | Rosas et al. | |

FOREIGN PATENT DOCUMENTS

| | | | | | |
|---|---|---|---|---|---|
| EP | 468860 | A | | 1/1992 | |
| GB | 2419345 | A | | 4/2006 | |
| GB | 2436830 | A | | 10/2007 | |
| KR | 20-1998-0067913 | U | | 12/1998 | |
| KR | 20-2008-0006523 | U | | 12/1998 | |
| KR | 10-2010-0052013 | A | | 5/2010 | |
| NL | 9301699 | A | | 5/1995 | |
| WO | 0068098 | | | 11/2000 | |
| WO | 01/66423 | A1 | | 9/2001 | |
| WO | 2006/026767 | A2 | | 3/2006 | |
| WO | WO 2006095097 | A2 | * | 9/2006 | A61L 2/26 |
| WO | 2010128874 | A1 | | 11/2010 | |

OTHER PUBLICATIONS

International Search Report and Written Opinion of the International Searching Authority for PCT/US2011/050347 mailed Mar. 19, 2012.
PCT Search Report and Written Opinion for PCT/US2014/010587 mailed May 14, 2014.

* cited by examiner

Table – 1

| Column-1 | Column-2 | Column-3 | Column-4 |
|---|---|---|---|
| Term | Scaled Estimate | | Prob>\|t\| |
| Intercept | 539.4151 | | <.0001* |
| Length Configuration[33] | 20.66904 | | 0.0445* |
| Length Configuration[32] | -1.13248 | | 0.8936 |
| Length Configuration[22] | -8.658217 | | 0.3866 |
| Length Configuration[base] | -10.87734 | | 0.1925 |
| Width Configuration[33] | 14.264829 | | 0.1315 |
| Width Configuration[22] | -21.87716 | | 0.0128* |
| Width Configuration[base] | 7.6123337 | | 0.3078 |
| Tab Length[10%] | -3.906408 | | 0.4910 |
| Tab Length[20%] | 3.9064078 | | 0.4910 |
| Tab Height-Length Panel[+1/2 caliper] | -42.0137 | | <.0001* |
| Tab Height-Length Panel[0] | 12.61573 | | 0.1199 |
| Tab Height-Length Panel[-1/2 caliper] | 29.397971 | | 0.0015* |
| Tab Height-Width Panel[+1/2 caliper] | 8.7163634 | | 0.2634 |
| Tab Height-Width Panel[0] | 5.1870722 | | 0.4996 |
| Tab Height-Width Panel[-1/2 caliper] | -13.90344 | | 0.0890 |
| Corner Space[At corner] | 24.336455 | | 0.0008* |
| Corner Space[Evenly Spaced] | -24.33646 | | 0.0008* |
| | 0 | | <.0001* |
| Box Length[max-20 in] | 3.5177117 | | 0.5584 |
| Box Length[min-14 in] | -3.517712 | | 0.5584 |
| Box Width[max- 14 in] | 19.343052 | | 0.0057* |
| Box Width[min- 8 in] | -19.34305 | | 0.0057* |
| Box Height[max- 16 in] | 5.6966262 | | 0.2512 |
| Box Height[min 6.25 in] | -5.696626 | | 0.2512 |

Fig. 13

Table – 2

| Column-1 | Column-2 | Column-3 | Column-4 |
|---|---|---|---|
| Term | Scaled Estimate | | Prob>\|t\| |
| Intercept | 1134.279 | | <.0001* |
| Length Configuration[33] | -13.43689 | | 0.5794 |
| Length Configuration[32] | -2.633495 | | 0.8984 |
| Length Configuration[22] | 7.1800077 | | 0.7670 |
| Length Configuration[base] | 8.8903779 | | 0.6779 |
| Width Configuration[33] | 28.050659 | | 0.2159 |
| Width Configuration[22] | 4.6369824 | | 0.8144 |
| Width Configuration[base] | -32.69364 | | 0.1541 |
| Tab Length[10%] | -24.85873 | | 0.1468 |
| Tab Length[20%] | 24.858728 | | 0.1468 |
| Tab Height-Length Panel[+1/2 caliper] | -43.24775 | | 0.0690 |
| Tab Height-Length Panel[0] | -20.58759 | | 0.3149 |
| Tab Height-Length Panel[-1/2 caliper] | 63.83534 | | 0.0069* |
| Tab Height-Width Panel[+1/2 caliper] | 8.3269766 | | 0.7521 |
| Tab Height-Width Panel[0] | 1.982915 | | 0.9161 |
| Tab Height-Width Panel[-1/2 caliper] | -10.30989 | | 0.6590 |
| Corner Space[At corner] | 9.4417152 | | 0.5432 |
| Corner Space[Evenly Spaced] | -9.441715 | | 0.5432 |
| | 0 | | <.0001* |
| Box Length[max-20 in] | 18.856477 | | 0.2543 |
| Box Length[min-14 in] | -18.85648 | | 0.2543 |
| Box Width[max- 14 in] | 82.183498 | | 0.0008* |
| Box Width[min- 8 in] | -82.1835 | | 0.0008* |
| Box Height[max- 16 in] | -19.41819 | | 0.1978 |
| Box Height[min 6.25 in] | 19.418188 | | 0.1978 |

Fig. 14

Table – 3

| Column-1 | Column-2 | Column-3 | Column-4 |
|---|---|---|---|
| Term | Scaled Estimate | | Prob>\|t\| |
| Intercept | 836.52175 | | <.0001* |
| Length Configuration[33] | 7.4755417 | | 0.6206 |
| Length Configuration[32] | 4.0294896 | | 0.7867 |
| Length Configuration[22] | -5.910084 | | 0.6795 |
| Length Configuration[base] | -5.594947 | | 0.6934 |
| Width Configuration[33] | 4.2873573 | | 0.7192 |
| Width Configuration[22] | -1.040452 | | 0.9312 |
| Width Configuration[base] | -3.246905 | | 0.7878 |
| Tab Length[10%] | -18.30369 | | 0.0376* |
| Tab Length[20%] | 18.30369 | | 0.0376* |
| Tab Height-Length Panel[+1/2 caliper] | -36.93731 | | 0.0041* |
| Tab Height-Length Panel[0] | -2.253309 | | 0.8513 |
| Tab Height-Length Panel[-1/2 caliper] | 39.19062 | | 0.0019* |
| Tab Height-Width Panel[+1/2 caliper] | -9.028906 | | 0.4637 |
| Tab Height-Width Panel[0] | 19.355386 | | 0.1145 |
| Tab Height-Width Panel[-1/2 caliper] | -10.32648 | | 0.3787 |
| Corner Space[At corner] | 19.886034 | | 0.0261* |
| Corner Space[Evenly Spaced] | -19.88603 | | 0.0261* |
| Board Combination[44C] | 299.89917 | | <.0001* |
| Board Combination[32B] | -299.8992 | | <.0001* |
| Box Length[max-20 in] | 16.725121 | | 0.0832 |
| Box Length[min-14 in] | -16.72512 | | 0.0832 |
| Box Width[max- 14 in] | 51.548987 | | <.0001* |
| Box Width[min- 8 in] | -51.54899 | | <.0001* |
| Box Height[max- 16 in] | -17.86503 | | 0.0404* |
| Box Height[min 6.25 in] | 17.865027 | | 0.0404* |

Fig. 15

PACKING CONTAINER

CROSS REFERENCE TO RELATED APPLICATIONS

This application claims the benefit of U.S. Provisional Application Ser. No. 61/379,808, filed Sep. 3, 2010, which is incorporated herein by reference in its entirety.

BACKGROUND OF THE INVENTION

The subject matter disclosed herein relates to containers, particularly to packing containers, and more particularly to packing containers suitably configured for stacking one on top of another.

Packing containers are often formed from a corrugated sheet product material that is cut with a die to form a flat blank, or scored and slotted to form a flat blank. The flat blank is folded into a three dimensional container that may be secured using an arrangement of flaps, adhesive liquids, or adhesive tapes.

In use, packing containers may be subjected to considerable forces during shipping, storage and stacking. It is desirable to increase the strength and rigidity of packing containers, particularly with respect to stacking, while reducing the amount of materials used to form the packing containers.

BRIEF DESCRIPTION OF THE INVENTION

According to an embodiment of the invention, a container includes a plurality of panels integrally arranged with respect to each other and with respect to a set of orthogonal x, y and z axes, the z-axis defining a direction line in which the container is configured to support a stacking load. The plurality of panels include a first panel having a first planar surface, and a second panel having a second planar surface, wherein the first panel and the second panel form a contiguity with a fold line disposed therebetween, and wherein the first planar surface is disposed parallel to the x-z plane or the y-z plane. The container further includes a compression reinforcement feature having a planar edge oriented orthogonal to the first planar surface and perpendicular to the z-axis, the planar edge being disposed a distance away from the fold line but at a distance no greater than half a thickness of the first panel, the first panel having a void between the fold line and the planar edge.

According to an embodiment of the invention, a container includes a plurality of panels having a first side panel, a second side panel, a first end panel, and second end panel, a top panel and a bottom panel, the plurality of panels being integrally arranged with respect to each other to form a box having four lateral sides configured to support a stacking load when exerted in a z-direction from the top panel toward the bottom panel. The first side panel and a first portion of the top panel form a contiguity with a first fold line disposed therebetween. The second side panel and a second portion of the top panel form a contiguity with a second fold line disposed therebetween. A first compression reinforcement feature is disposed proximate the first fold line and proximate the first end panel. A second compression reinforcement feature is disposed proximate the first fold line and proximate the second end panel. A third compression reinforcement feature is disposed proximate the second fold line and proximate the first end panel. A fourth compression reinforcement feature is disposed proximate the second fold line and proximate the second end panel. Each of the first and second compression reinforcement features have a planar edge oriented orthogonal to the first side panel and perpendicular to the z-direction, each respective planar edge being disposed a distance away from the first fold line but at a distance no greater than half a thickness of the first panel, the first panel having a void between the first fold line and each respective planar edge. Each of the third and fourth compression reinforcement features have a planar edge oriented orthogonal to the second side panel and perpendicular to the z-direction, each respective planar edge being disposed a distance away from the second fold line but at a distance no greater than half a thickness of the second panel, the second panel having a void between the second fold line and each respective planar edge.

According to an embodiment of the invention, a container includes a plurality of panels integrally arranged with respect to each other and with respect to a set of orthogonal x, y and z axes, the z-axis defining a direction line in which the container is configured to support a stacking load. The plurality of panels include a first panel having a first planar surface, and a second panel having a second planar surface, wherein the first panel and the second panel form a contiguity with a fold line disposed therebetween, wherein the first planar surface is disposed parallel to the x-z plane or the y-z plane, and wherein the second panel is disposed orthogonal to the first panel. The container also includes a compression reinforcement feature having a planar edge oriented orthogonal to the first planar surface and perpendicular to the z-axis, the compression reinforcement feature includes a tab that extends from and is coplanar with the first panel and that terminates at the planar edge, the planar edge being disposed a distance away from a planar outer surface of the second panel but at a distance no greater than half a thickness of the first panel. The plurality of panels further comprises a third panel adhered to the outer surface of the second panel proximate the tab.

According to an embodiment of the invention, a container includes a plurality of panels having a first side panel, a second side panel, a first end panel, and second end panel, a top panel and a bottom panel, the plurality of panels being integrally arranged with respect to each other to form a box having four lateral sides configured to support a stacking load when exerted in a z-direction from the top panel toward the bottom panel. The first side panel and a first portion of the top panel form a contiguity with a first fold line disposed therebetween. The first side panel and a first portion of the bottom panel form a contiguity with a second fold line disposed therebetween. A first compression reinforcement feature is disposed proximate the first fold line and proximate the first end panel. A second compression reinforcement feature is disposed proximate the first fold line and proximate the second end panel. A third compression reinforcement feature is disposed proximate the second fold line and proximate the first end panel. A fourth compression reinforcement feature is disposed proximate the second fold line and proximate the second end panel. Each of the first and second compression reinforcement features have a planar edge oriented orthogonal to the first side panel and perpendicular to the z-direction, each of the first and second compression reinforcement features include a tab that extends from and is coplanar with the first side panel and that terminates at a respective planar edge, each respective planar edge being disposed a distance away from an outer surface of the top panel but at a distance no greater than half a thickness of the first panel. Each of the third and fourth compression reinforcement features have a planar edge oriented orthogonal to the first side panel and perpendicular to the z-direction, each respective planar edge of the third and fourth compression reinforcement features being disposed a distance away from the second fold line but at a distance no greater than half a thickness of the first side panel, the first side panel includes a void between the second fold line and each respective planar edge of the third and fourth compression reinforcement features.

According to an embodiment of the invention, a flat blank includes a first panel and a second panel that form a contiguity with a fold line disposed therebetween. The flat blank also includes a compression reinforcement feature formed by a cut line that begins at a first point on the second panel, traverses a first distance along a first line that extends across the fold line, traverses a second distance along a second line that runs substantially parallel to the fold line, and traverses a third distance along a third line that extends back across the fold line to end at a second point on the second panel, wherein the second line defines a location of a planar edge of the compression reinforcement feature, and wherein the planar edge is disposed a distance away from the fold line but at a distance no greater than half a thickness of the first panel.

According to an embodiment of the invention, a flat blank includes a first panel and a second panel that form a contiguity with a fold line disposed therebetween. The flat blank also includes a compression reinforcement feature formed by a cut line that begins at a first point on the first panel, traverses a first distance along a first line that extends across the fold line, traverses a second distance along a second line that runs substantially parallel to the fold line, and traverses a third distance along a third line that extends back across the fold line to end at a second point on the first panel, wherein the second line defines a location of a planar edge of the compression reinforcement feature, and wherein the planar edge is disposed a distance away from the fold line but at a distance no greater than a full thickness of the first panel.

According to an embodiment of the invention, a container includes a first panel comprising a planar surface, a second panel comprising a planar surface, wherein the first panel and the second panel form a contiguity with a fold line disposed therebetween, and a tabular region extending from the first panel, the tabular region arranged proximate to the fold line and coplanar with the planar surface of the first panel.

According to an embodiment of the invention, a container includes a bottom panel, a top panel opposing the bottom panel, a first side panel, a second side panel opposing the first side panel, a front panel, a rear panel opposing the front panel, and a first tabular region extending from the first side panel arranged coplanar with a planar surface of the first side panel.

According to an embodiment of the invention, a flat blank includes a first panel comprising a planar surface, a second panel comprising a planar surface, wherein the first panel and the second panel form a contiguity with a fold line disposed therebetween, and a tabular region defined by a cut line in the first panel.

According to an embodiment of the invention, a container includes a first panel comprising a planar surface, a second panel comprising a planar surface, wherein the first panel and the second panel form a contiguity with a fold line disposed therebetween, and a cut-out region of the second panel, the cut-out region partially defined by the fold line, a exposed edge of the first panel, the exposed edge partially defined by the cut-out region.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 13 depicts Table-1 that provides DOE box compression test (BCT) scaled estimates for a container made from lightweight fluted containerboard having B-flute and a minimum edgewise compression test specification of 32 lbs/inch.

FIG. 14 depicts Table-2 that provides DOE BCT scaled estimates similar to those of Table-1, but for a container made from heavyweight fluted containerboard having C-flute and a minimum edgewise compression test specification of 44 lbs/inch.

FIG. 15 depicts Table-3 that provides DOE BCT scaled estimates similar to those of Tables-1 and 2, except that it combines the data from Tables-1 and 2, hence the additional entries of "Board Combination [44C]" and "Board Combination [32B]" in Column-1.

DETAILED DESCRIPTION OF THE INVENTION

Figure 1:
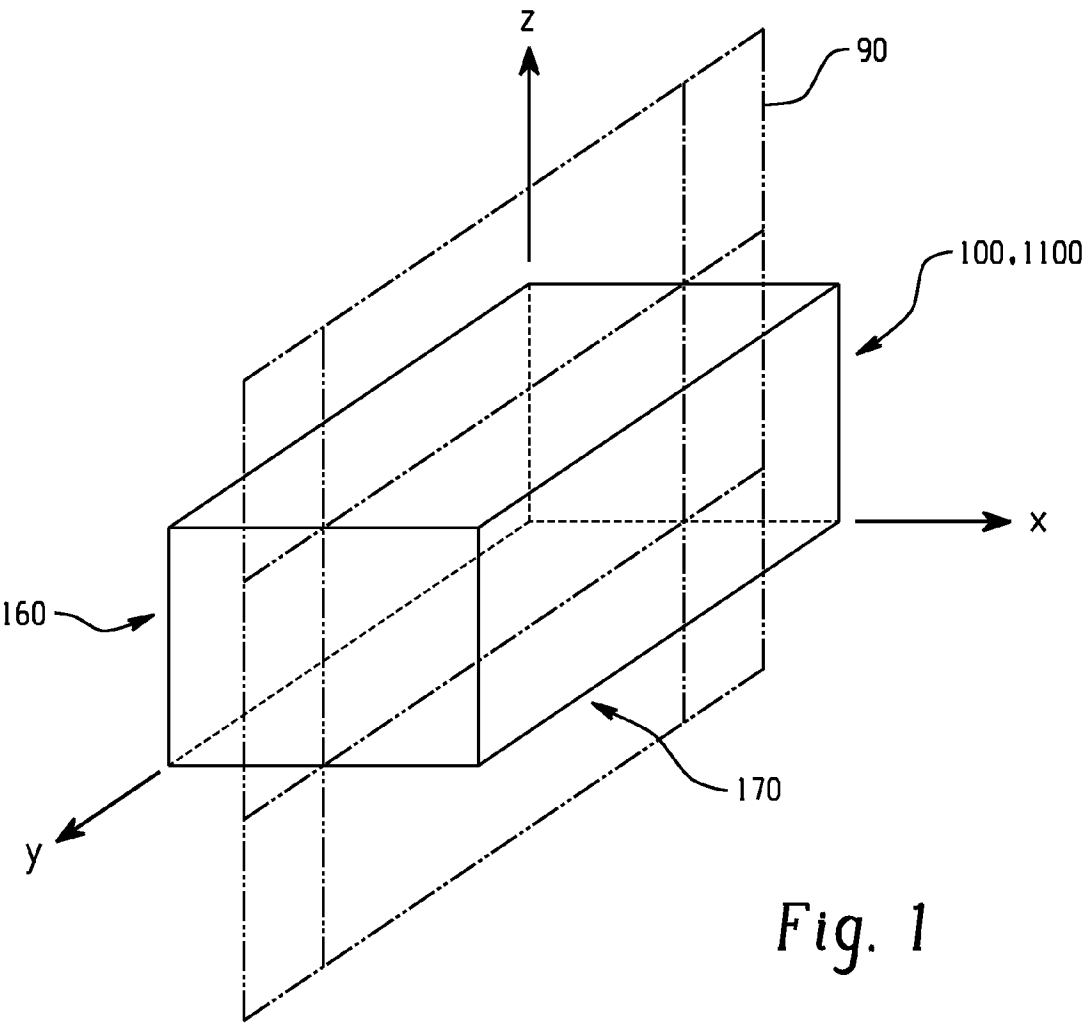
FIG. 1 illustrates a perspective view of a container relative to x, y and z axes, and a cutting plane that bisects the container lengthwise.

A packing container, also referred to as a carton or simply as a container, may be fabricated by, for example, cutting or scoring a sheet product with a die or other type of cutting or scoring tool, such as cutting, scoring and slotting tooling and equipment, to form a flat sheet having various panels, flaps, tabs, recesses and creases. The sheet may be folded and secured using, for example, adhesive liquids, tapes or mechanical means such as staples or straps to form a three dimensional packing container. Packing containers may be formed from a variety of sheet products. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentangled (sometimes called spunlace), DRC (double re-creped), airlaid, spunbond, carded, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Sheet product for packing containers may also include corrugated fiber board, which may be made from a variety of different flute configurations, such as A-flute, B-flute, C-flute, E-flute, F-flute, or microflute, for example.

In use, a packing container may be subjected to various forces during handling, shipping and stacking of the packing container including, for example, compressive forces exerted between the top and bottom panels of the container. It is desirable for a packing container to withstand the various forces to protect objects in the container and to maintain a presentable appearance following shipping. It is also desirable to reduce the amount of materials used to form the packing container while maintaining design specifications for strength and rigidity.

In an embodiment of a container having one or more symmetrical panels oriented parallel with the x-y plane (discussed below) it has been found, with respect to the symmetrical panel, that a compression reinforcement feature formed by removal or displacement of a small amount of container sidewall material below an upper fold line (or above a lower fold line) on a length-wise side panel of the container can improve stacking strength (also herein referred to as compression strength) of the associated container, while in an embodiment of a container having one or more asymmetrical panels oriented parallel with the x-y plane (also discussed below) it has been found, with respect to the asymmetrical panel, that a compression reinforcement feature formed by extending a small amount of container sidewall material, such as in the form of a tab, above an upper fold line (or below a lower fold line) on a length-wise side panel on an edge proximate a folded over lap joint, can improve stacking strength of the associated container. Such findings are based on substantial experimentation, both design of experiments experimentation and empirical experimentation, involving many parameters, where some of the parameters were found to be statistically significant, while other ones of the parameters were found to be statistically insignificant.

FIG. 1 depicts a container 100, 1100 having a plurality of panels (such as sides, ends, top and bottom panels, for example) integrally arranged with respect to each other and with respect to a set of orthogonal x, y and z axes, where the z-axis defines a direction line in which the container 100 is configured to support a stacking load. Also depicted in FIG. 1 is a graphical cutting plane 90 that illustrates a planar cut through a middle of the container 100, 1100 to form two equally sized halves, a left half 160 and a right half 170. In the case of a container structure having one or more symmetrical panels oriented parallel with the x-y plane (see bottom panel 106 of container 100, for example), such as with some slotted containers (SCs) or a regular slotted container (RSC), the left and right halves 160, 170 of the respective panels oriented parallel with the x-y plane would be mirror images of each other. In the case of container structure having one or more asymmetrical panels oriented parallel with the x-y plane (see top panel 108 of container 100, for example), such as with an overlapped slotted container (OSC), whether it be fully overlapped or partially overlapped with a lap joint, the left and right halves 160, 170 of the respective panels oriented parallel with the x-y plane would not be mirror images of each other, as one half would contain more of the overlapping flap and lap joint than the other half would. As depicted in FIG. 1, the cutting plane 90 cuts through the container 100 lengthwise, such that the overlapped joint that is part of the asymmetrical top panel 108, 108' is disposed on one side of the cutting plane 90, such as in the left half 160, for example. In view of the symmetrical and asymmetrical panels (top and/or bottom) having different structures, it has been found that a compression reinforcement feature suitable for one is not necessarily suitable for another. However, it has also been found that the different compression reinforcement features may be mixed, which will also be discussed further below.

As used herein, reference to side panels and end panels, also referred to in combination as lateral panels, is in reference to those panels oriented orthogonal to the x-y plane (see FIG. 1 for example), and reference to top and bottom panels is in reference to those panels oriented parallel to the x-y plane.

As used herein, the terms orthogonal (perpendicular) and parallel should be interpreted as being substantially orthogonal (perpendicular) and substantially parallel, respectively. For example, the term orthogonal in relation to planar surfaces should be interpreted to include two planar surfaces having an angle therebetween from 85-degrees to 95-degrees, or more typically from 88-degrees to 92-degrees, depending on whether the measurement is taken when the container is in a non-compressed state or a compressed state. And the term parallel in relation to planar surfaces should be interpreted to include two planar surfaces having an angle therebetween from +5-degrees to −5-degrees, or more typically from +2-degrees to −2-degrees, depending on whether the measurement is taken when the container is in a non-compressed state or a compressed state.

As used herein, any reference to a dimension or a percentage value should not be construed to be the exact dimension or percentage value stated, but instead should be understood to mean a dimension or percentage value that is "about" the stated dimension or percentage value, except where it is clear from the description and usage as presented herein.

Figure 2:
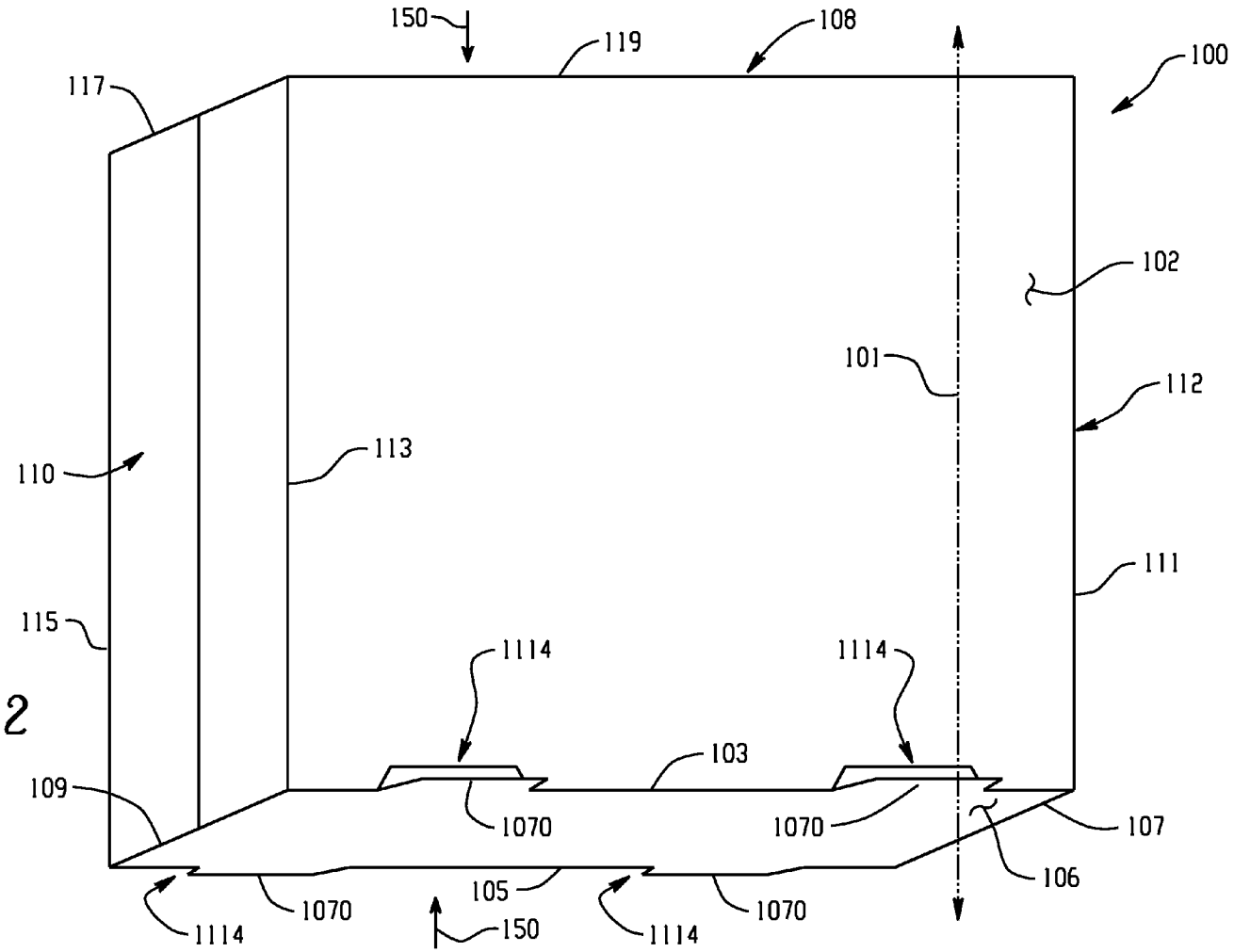
FIG. 2 illustrates a perspective view of an assembled packing container in accordance with an embodiment of the invention.
Figure 3:
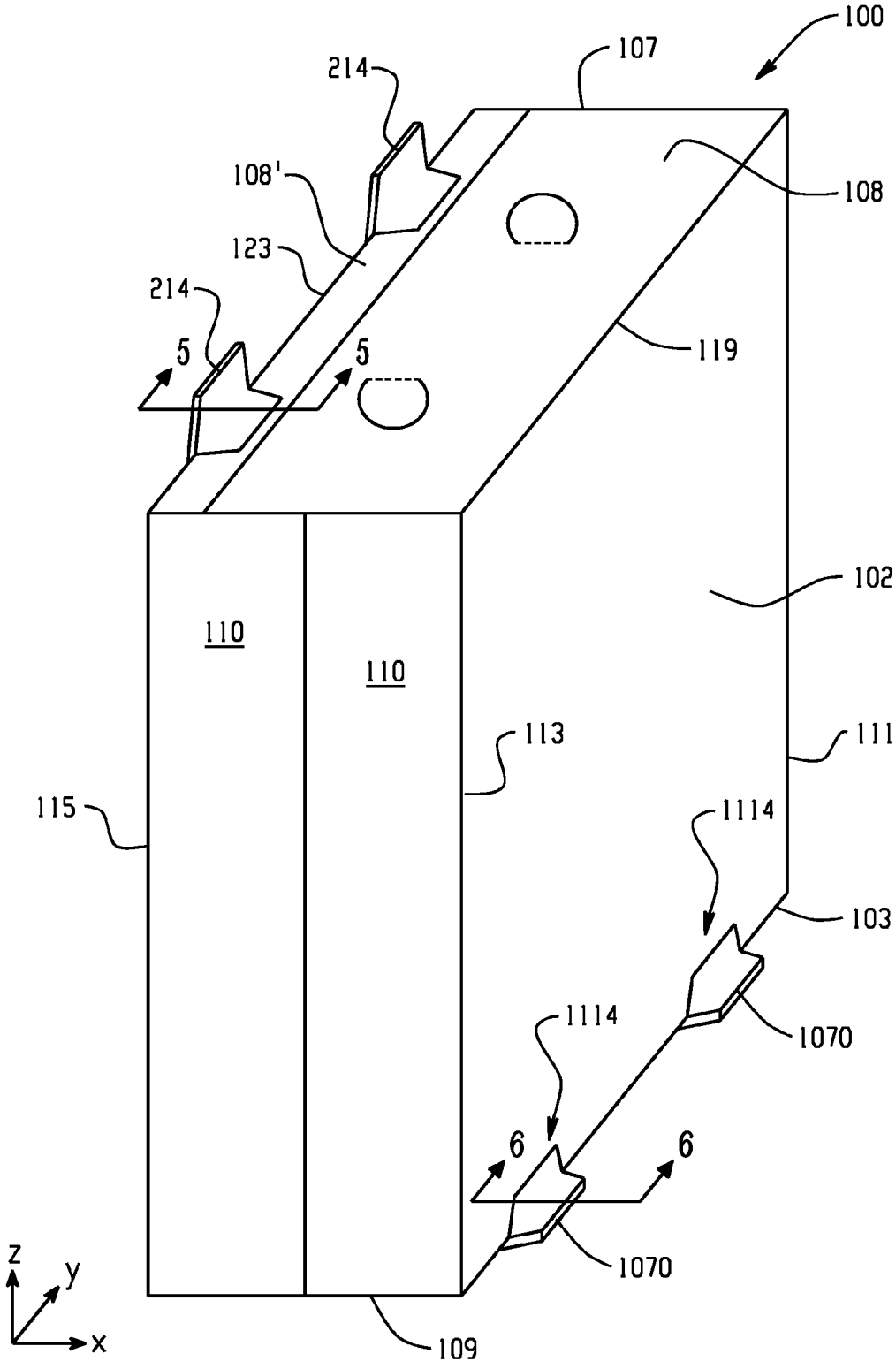
FIG. 3 illustrates another perspective view of the container of FIG. 2.
Figure 4:
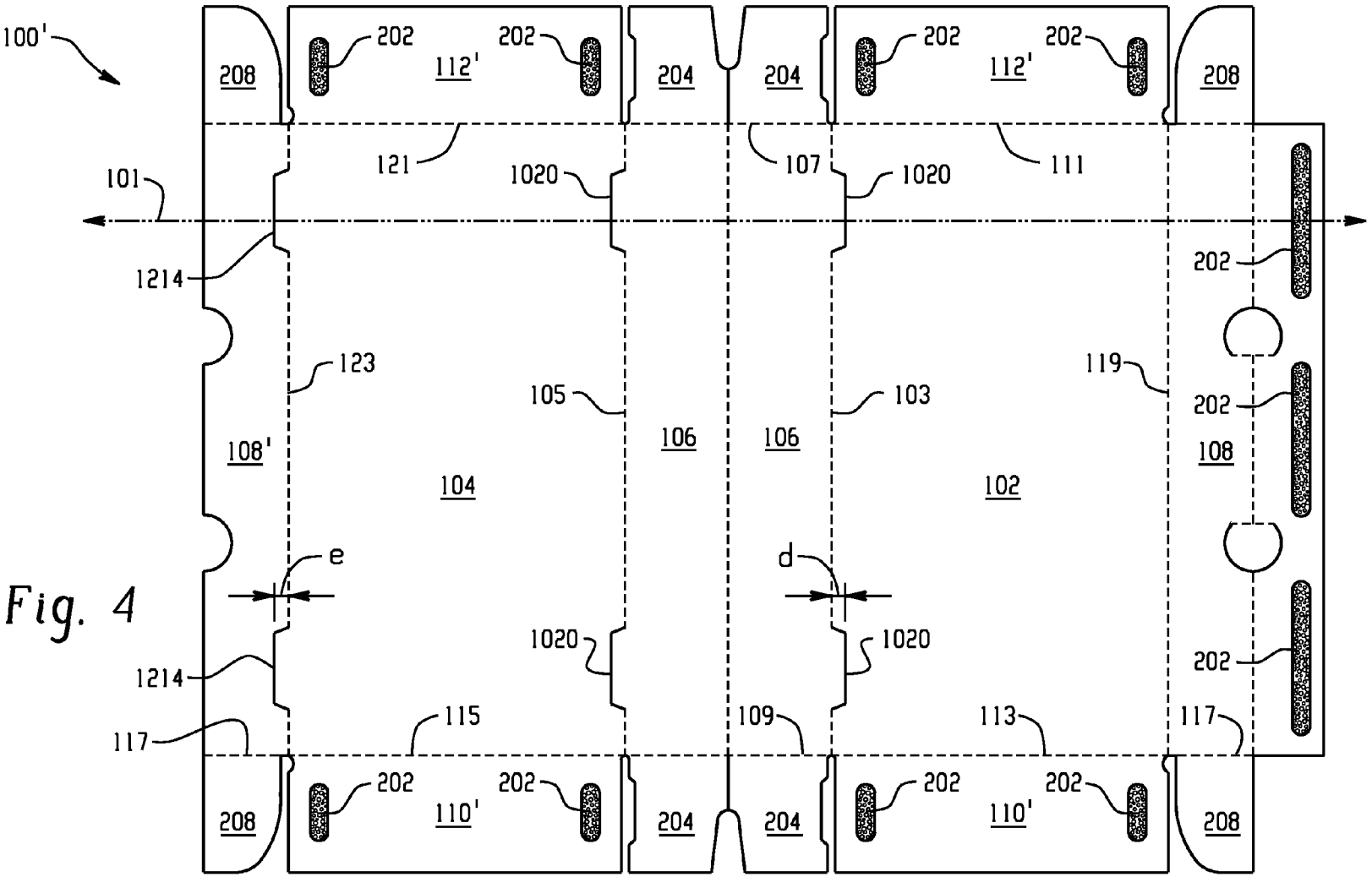
FIG. 4 illustrates a plan view of an unassembled flat blank for the container of FIG. 3.

FIGS. 2 and 3 illustrate different perspective views of an embodiment of an assembled packing container 100. FIG. 4 illustrates a flat blank 100' used to form the container 100. In the flat blank 100', dashed lines represent fold lines and solid lines represent cut lines, except where solid lines enclose hashed lines that represent areas of adhesive. The container 100 includes a first side panel 102 opposing a second side panel 104 (hidden from view in FIG. 2, but shown in FIG. 3); a bottom panel 106 opposing a top panel 108 (hidden from view in FIG. 2, but shown in FIG. 3); and a front panel 110 opposing a rear panel 112 (hidden from view in FIG. 2, but shown in FIG. 3). The intersections of the panels define folded edges 103, 105, 107, 109, 111, 113, 115, 117, 119, 121, and 123 (edges 121 and 123 shown in FIG. 3). In the illustrated embodiment, the side panels 102 and 104 include compression reinforcement features (CRFs) 1114, where each CRF 1114 is formed from a cut line 1020 (see FIG. 4) that serves to create voids or recesses 1050 (see FIG. 6) in the side panels 102, 104, and a tab 1070 (see FIGS. 2 and 3) when the flat blank 100' is folded to form container 100. As illustrated, the tabs 1070 are coplanar continuous extension of the bottom panel 106 and are arranged substantially perpendicular to the side panels 102, 104 in the folded container 100. In an embodiment, the container 100 is formed from a corrugated sheet material having a fluted corrugated sheet disposed between opposing liner boards. In an embodiment, the corrugated sheet is arranged such that the longitudinal axes of the flutes are orientated in parallel with the direction line 101, which in the example embodiment is oriented parallel with the z-axis. Alternate embodiments may include flutes that may be oriented perpendicular with the direction line 101 or at an oblique angle to the direction line 101, or may include sheet material having no flutes.

The number of CRFs 1114, the arrangement of the CRFs 1114, and the dimensions of the CRFs 1114 have been found to improve the compression strength of the container 100 depending on the dimensions of a particular container and the materials used to fabricate the container. Thus, the illustrated embodiments of FIGS. 2-4 are merely examples. Other embodiments may use any combination of CRFs similar to the CRFs 1114 in alternate arrangements, such as for example one or more CRFs arranged on a panel of a container. Including, for example, one or more CRFs arranged adjacent to a bottom panel, one or more CRFs arranged adjacent to a bottom panel along opposing edges of the bottom panel, one or more CRFs adjacent to a top panel, one or more CRFs adjacent to a top panel along opposing edges of the top panel, or any combination of the embodiments discussed above, as long as the CRFs are employed in a manner consistent with the discussion herein regarding symmetrical and asymmetrical panels.

With respect to symmetrical and asymmetrical panels, and with reference to FIGS. 3 and 4, an embodiment of container 100 includes two CRFs 214 in the form of tabs disposed on a same lengthwise edge of the container 100, with each tab of CRF 214 disposed proximate opposing corners (near end panels 110, 112*s*) of the container 100, and with both tabs of CRFs 214 formed from glue flap 108' and disposed coplanar with the side panel 104 of the container 100 that forms a contiguous folded-under glue flap 108' (see FIGS. 4 and 5), has also been found to have an increase in compression strength where the height of the tabs of CRFs 214, relative to an upper surface of glue flap 108', is greater than zero and equal to or less than half the thickness of the panel 104 from which they are formed. Each tab of CRF 214 is formed from a cut line 1214 (see FIG. 4) that serves to create the aforementioned tab when the flat blank 100' is folded to form container 100. In an embodiment, the panel is a C-flute panel and the height of the tabs of CRFs 214 is greater than zero and equal to or less than 3/32 of an inch. While FIG. 3 also depicts CRFs 1114 proximate the bottom panel 106, it has been found that an increase in compression strength can be attributed to CRFs 214 independent of whether CRFs 1114 are present or not. However, when CRFs 1114 are present, further compression strength is gained.

While FIG. 3 depicts CRFs 214 disposed only proximate the top panel 108 where the top panel 108 overlaps the glue flap 108', it will be appreciated that a container may also be constructed in such a manner as to have similar overlapped panels that form the bottom panel, that is, in place of the illustrated bottom panels 106 depicted in FIGS. 3 and 4. As such, it will be appreciated that CRFs 214 may also be disposed proximate a bottom panel formed from such overlapped panels. As such, any reference to a container having CRFs 214 disposed proximate the top panel 108 is also intended to encompass a container having CRFs 214 disposed proximate an overlapped bottom panel.

As mentioned above, FIG. 4 illustrates an embodiment of a flat blank 100' used to form the container 100 and prior to assembly into a three dimensional shaped container. The solid lines that represent cut lines may be cut by, for example, a cutting die, a scoring and slotting tool, or another other type of cutting device. In fabrication, an adhesive is applied to regions 202 such that flaps 204 and 208 are connected to corresponding panels in an overlapped manner. In the illustrated embodiment, the side panels 110 and 112 (of FIGS. 2 and 3) are formed from panels 110' and 112' (of FIG. 4) respectively, and the top panel 108 is formed by panel 108 overlapping a panel 108' (of FIGS. 3 and 4). The illustrated embodiment includes tabs 214 that form tabs extending from the side panel 104 along the edge 123 as discussed above.

Folding the sheet product to form the edges 103 and 105 compresses the corrugated sheet between the opposing liner boards which may, for example, result in buckling, sagging, or shearing when an excessive compressive force is applied in a direction along the lines 150, that is, along a direction line parallel to the z-axis. The CRFs 1114 remain coplanar with the respective side panels 102 and 104, and are not folded or creased when the container 100 is assembled. More particularly, the cut line 1020 forming each CRF 1114 is not deformed when the container 100 is folded. Thus, the corrugated sheet material in the CRFs 1114 remains unfolded and may withstand greater compressive forces than the adjacent folded edges 103 and 105. As such, it will be appreciated that the recesses 1050 form the compression reinforcement features (CRFs) 1114 on the container 100. Similarly, folding the sheet product to form edge 123 also compresses the corrugated sheet. However, CRFs 214 remain coplanar with the side panel 104. Thus, the corrugated sheet material in the CRFs 214 remains unfolded and may likewise withstand greater compressive forces than the adjacent folded edge 123. As such, it will be appreciated that the tabs 214 form the compression reinforcement features (CRFs) 214 on the container 100.

Experimental testing of the container 100, where side panels 102 and 104 are different dimensions, using a box compression test (BCT) has shown an improvement in BCT results up to 11% over similar containers that did not include the tabs 214.

The testing results varied depending on the arrangement and number of tabs. In this regard, a control container having no tabs was found to have a BCT of 384±9 lbs. A first test container having two tabs similar to the tabs 214 depicted in FIG. 3 arranged such that the pair of tabs 214 is arranged on a first side panel 104 (hidden from view in FIG. 3 but parallel to panel 102) adjacent to top panels 108, 108' resulted in a BCT of 426±19 lbs. (a +11% improvement over the control container).

Figure 5:
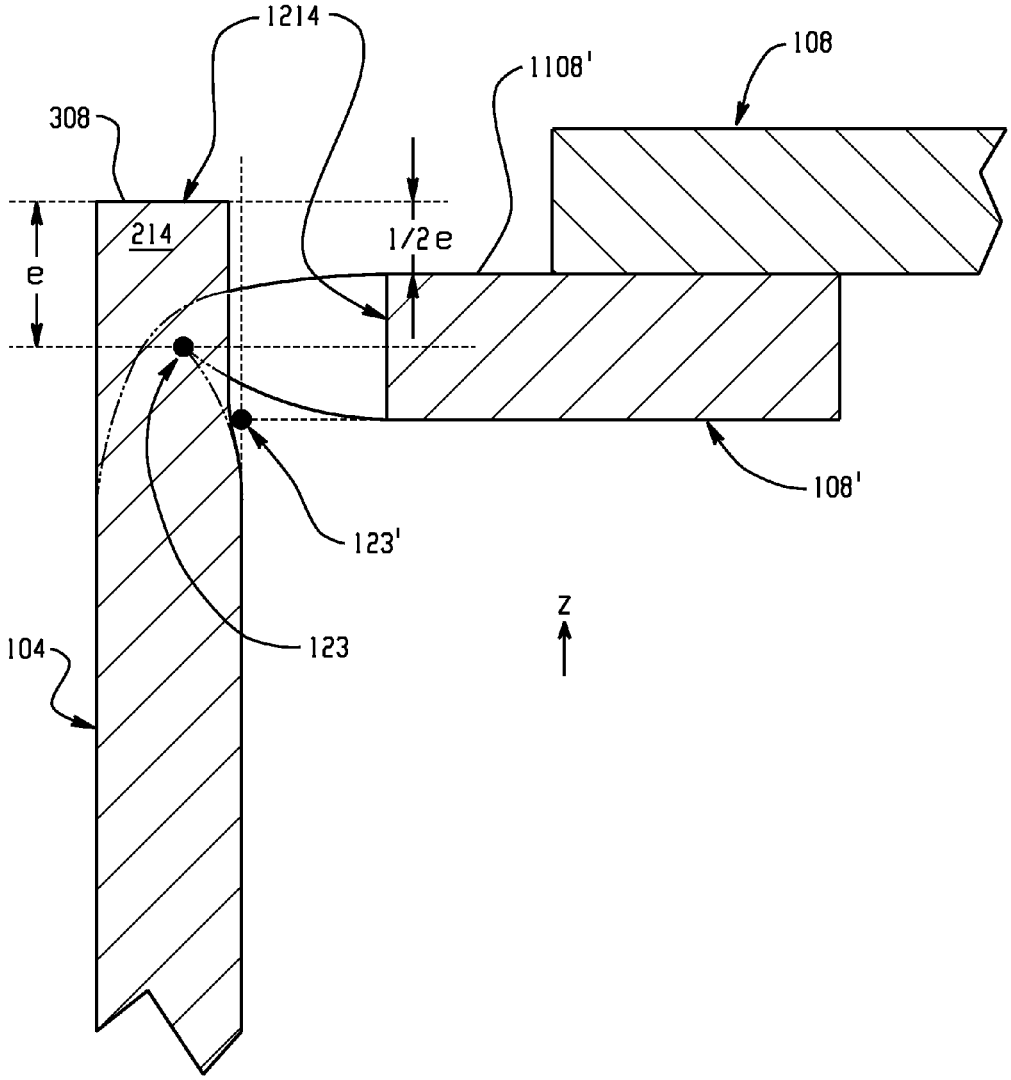
FIG. 5 illustrates in cross section view a portion of the container of FIG. 3 along cut line 5-5.

FIG. 5 illustrates an exaggerated detailed section view through the tab of CRF 214, and through the overlapping region of upper panel 108 overlapping lower panel 108', of FIG. 3. As will be appreciated when folding container material, such as corrugated material for example, a theoretical fold line 123' associated with a container material that would not buckle when folded will in actuality translate slightly inward toward fold line 123 in the folded container 100 as the container material buckles during the folding process. The resulting crease defines the location of the fold line 123 in the flat blank 100' when unfolded, and the location of the fold line 123 in the folded container 100. From the foregoing and with reference to FIG. 5, it will be appreciated that fold line 123 will be the same as fold line 123' before any creases, scores or folds are made to the containerboard used in making the container 100, 1100. As noted above, substantial experimentation, utilizing both design of experiments experimentation and empirical experimentation, has provided a particular arrangement for the height of the tabs of CRFs 214 relative to the fold line 123, or relative to the outer surface 1108' of panel 108', to obtain the advantage of increased compressive strength disclosed herein. As illustrated in FIG. 5, the height of the tab of CRF 214 relative to the translated fold line 123 is represented by dimension "e", and the height of the tab of CRF 214 relative to the outer surface 1108' of panel 108' is represented by dimension "½e" (that is, dimension "½e" measures half the dimension of dimension "e"). In an embodiment, dimension "e" is greater than zero and equal to or less than the thickness (caliper) of panel 104. In an embodiment, dimension "½e" is greater than zero and equal to or less than 3/32 of an inch. As used herein, the dimension "½e" is measured in a condition where the glue flap panel 108' is orthogonal to the side panel 104, and is measured from a planar outer surface of glue flap panel 108'.

With reference to FIGS. 4 and 5, the tabs of CRFs 214 are shown extending from the side panel 104. The cut lines 1214 define the tabs of CRFs 214 such that the tabs are disengaged from a portion of the top panel 108' when the container 100 is folded to form the edge 123 (see FIG. 3). The side panel 104 and the top panel 108' forms a contiguity with the fold line 123 disposed therebetween. The arrangement of the cut lines 1214 and the edge 123 allows the tabs of CRFs 1214 to be formed without deforming the corrugated fluted material that runs continuously between the side panel 104 and the tabs of CRFs 214. The orientation of the longitudinal axes of the flutes of the corrugated fluted material is illustrated by the z-axis. The formed tabs of CRFs 214 include a longitudinal edge having a planar surface 308 defined by the thickness of the corrugated material. In the illustrated embodiment, the planar surface 308 is arranged parallel to the top panel 108' and perpendicular to the outer surface of the side panel 104.

Figure 6:
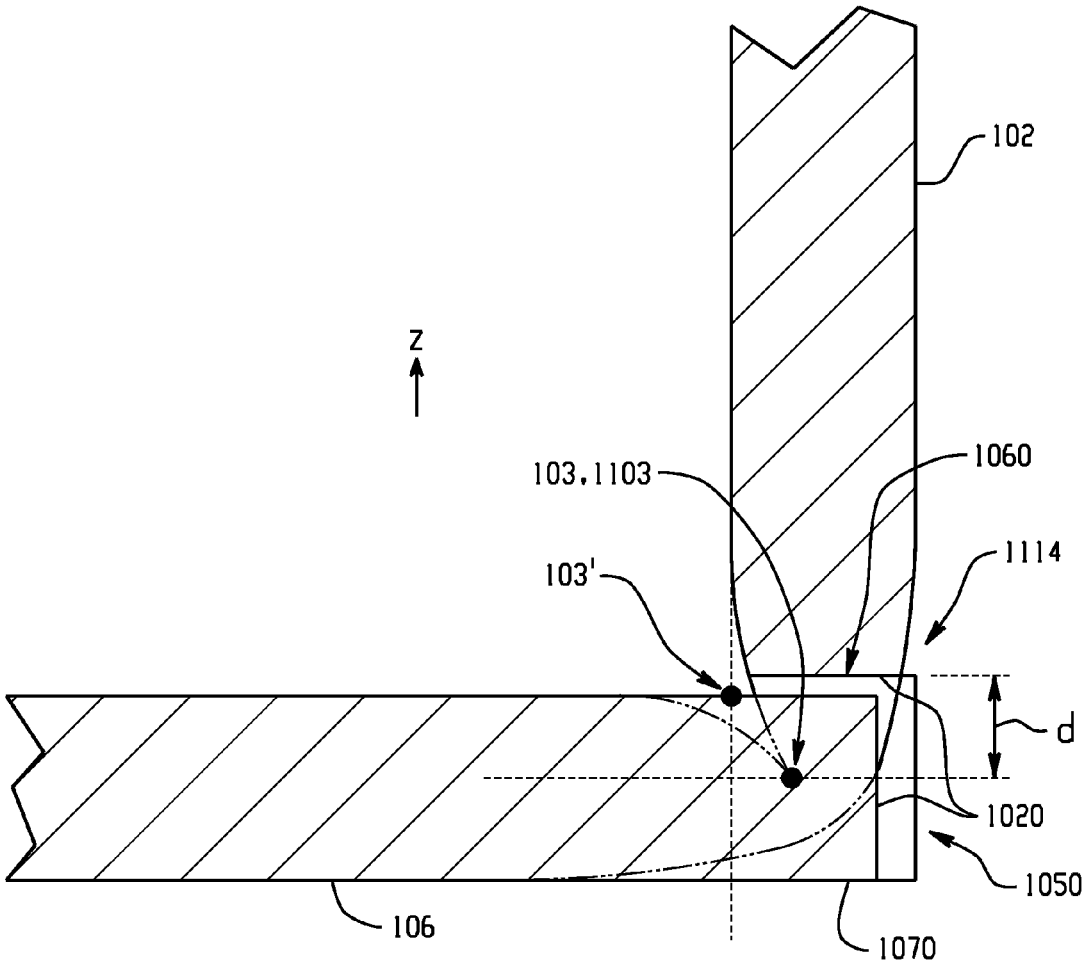
FIG. 6 illustrates in cross section view a portion of the container of FIG. 3 along cut line 6-6.

FIG. 6 illustrates an exaggerated detailed section view through the CRF 1114 of FIG. 3. Similar to the discussion above, it will be further appreciated that when folding the container material, a theoretical fold line 103' associated with a container material that would not buckle when folded will in actuality translate slightly inward toward and to create fold line 103 in the folded container 100 as the container material buckles during the folding process. The resulting crease defines the location of the fold line 103 in the flat blank 100' when unfolded, and the location of the fold line 103 in the folded container 100. From the foregoing and with reference to FIG. 6, it will be appreciated that fold line 103 will be the same as fold line 103' before any creases, scores or folds are made to the containerboard used in making the container 100, 1100. As noted above, substantial experimentation, utilizing both design of experiments experimentation and empirical experimentation, has provided a particular arrangement for the height of the voids or recesses 1050 of CRFs 1114 relative to the fold line 103 to obtain the advantage of increased compressive strength disclosed herein. As illustrated in FIG. 6, the height of the recess 1050 of CRF 1114 relative to the translated fold line 103 is represented by dimension "d". In an embodiment, dimension "d" is greater than zero and equal to or less than one half the thickness (caliper) of panel 102. In an embodiment, dimension "d" is greater than zero and equal to or less than 3/32 of an inch.

With reference to FIGS. 4 and 6, CRFs 1114 are shown extending coplanar with the side panel 102, and tabs 1070 are shown extending from the bottom panel 106. The cut lines 1020 define the CRFs 1114 such that the tabs 1070 are disengaged from a portion of the side panel 102 when the container 100 is folded to form the edge 103 (see FIG. 3). The side panel 102 and the bottom panel 106 form a contiguity with the fold line 103 disposed therebetween. The arrangement of the cut lines 1020 and the edge 103 allows the CRFs 1114 to be formed without substantially deforming the corrugated fluted material that runs continuously between the side panel 102 and the CRFs 1114. The orientation of the longitudinal axes of the flutes of the corrugated fluted material is illustrated by the z-axis. The formed CRFs 1114 include a longitudinal edge having a planar surface 1060 defined by the thickness of the corrugated material. In the illustrated embodiment, the planar surface 1060 is arranged parallel to the bottom panel 106 and perpendicular to the outer surface of the side panel 102.

Comparing FIGS. 5 and 6 with FIG. 4 shows dimension "e" associated with CRF 214 formed from cut line 1214, and dimension "d" associated with CRF 1114 formed from cut line 1020.

While embodiments have been described herein having particular characteristic dimensions such as "d", "e", and "½e", for example, it will be appreciated that respective tabs of CRFs 214 need not all be the same height relative to the fold line 123, and that respective recesses 1050 of CRFs 1114 need not be all the same height relative to the fold line 103.

Figure 7:
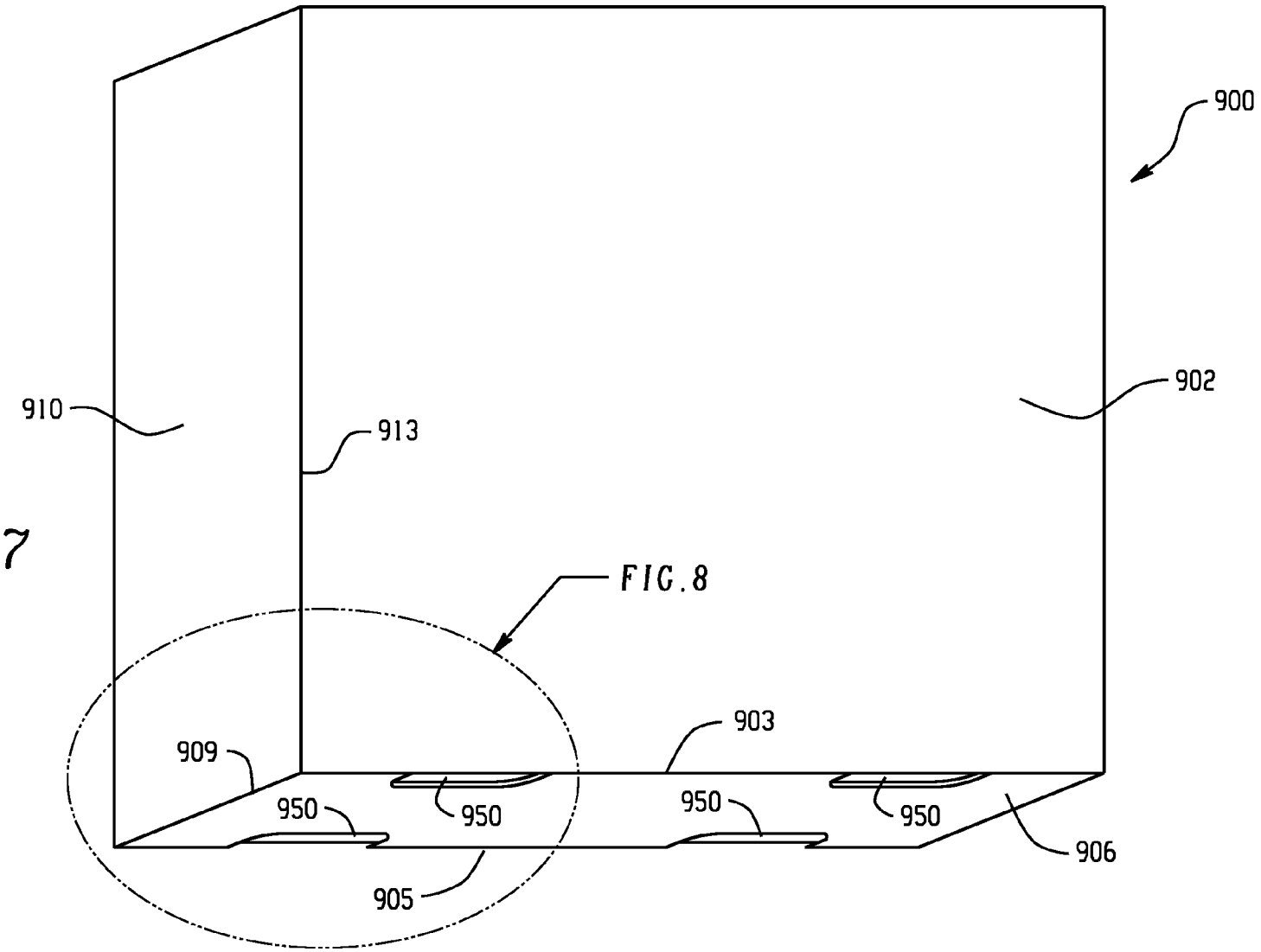
FIG. 7 illustrates a perspective view of an assembled packing carton in accordance with an alternate embodiment of the invention.
Figure 8:
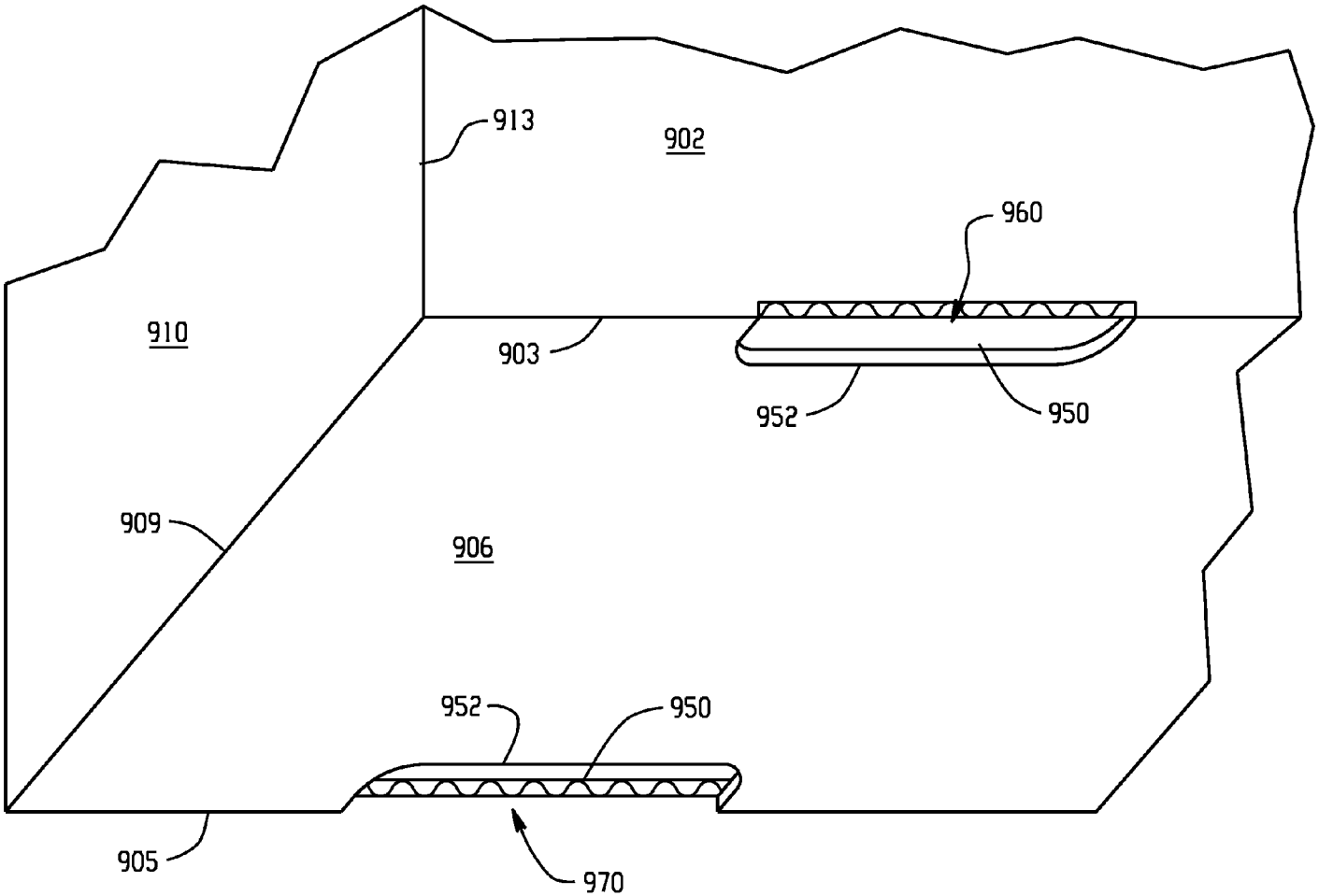
FIG. 8 illustrates a detailed view of the region 8 of FIG. 7.

Referring now to FIG. 7, which illustrates an embodiment of a packing container 900 alternative to that of container 100. The illustrated embodiment includes a side panel 902 and an opposing similar side panel 904 (hidden from view), a bottom panel 906, and a front panel 910. The panels are partially defined by folded edges 903, 905, 909, and 913. The bottom panel 906 is partially defined by cut-out regions 950 that expose edges of the side panels 902 and 904. FIG. 8 illustrates a detailed view of the region 8 (of FIG. 7). Referring to FIG. 8, the cut-out regions 950 are defined by cut lines 952 in the bottom panel 906. In fabrication, the cut line 952 defines a region in the bottom panel 906 that is removed. Removing the defined region and folding the material along the folded edges 903 and 905 exposes an edge 960 of the side panel 902 and an edge 970 of the side panel 904. The exposed edges 960 and 970 also serve to improve the strength of the container 900 as discussed above regarding the CRFs 1114 (of FIG. 2) by providing an unfolded region of the side panels 902 and 904 that increases the compressive strength integrity of the container 900 as compared to a similar container having no cut-out regions 950. In the illustrated embodiment, the planar surface defined by the exposed edges 960 and 970 is arranged in parallel to the planar outer surface of the bottom panel 906. The planar surface of the exposed edges 960 and 970 may be arranged coplanar with the outer surface of the bottom panel 906, or in alternate embodiments, may be recessed such that there is a spatial distance defined by the outer plane of the bottom surface 906 and the respective planes of the exposed edges 960, 970. In an embodiment, the amount of recess is greater than zero and equal to or less than half the thickness of the side panel 902. In an embodiment, the amount of recess is greater than zero and equal to or less than 3/32 of an inch. The container 900 may include any number of exposed edges similar to the exposed edges 960 and 970 arranged with any of the panels of the container 900. For example, a top panel of the container 900 may include one or more cut-out regions 950 and exposed edges 960 and 970.

Figure 9:
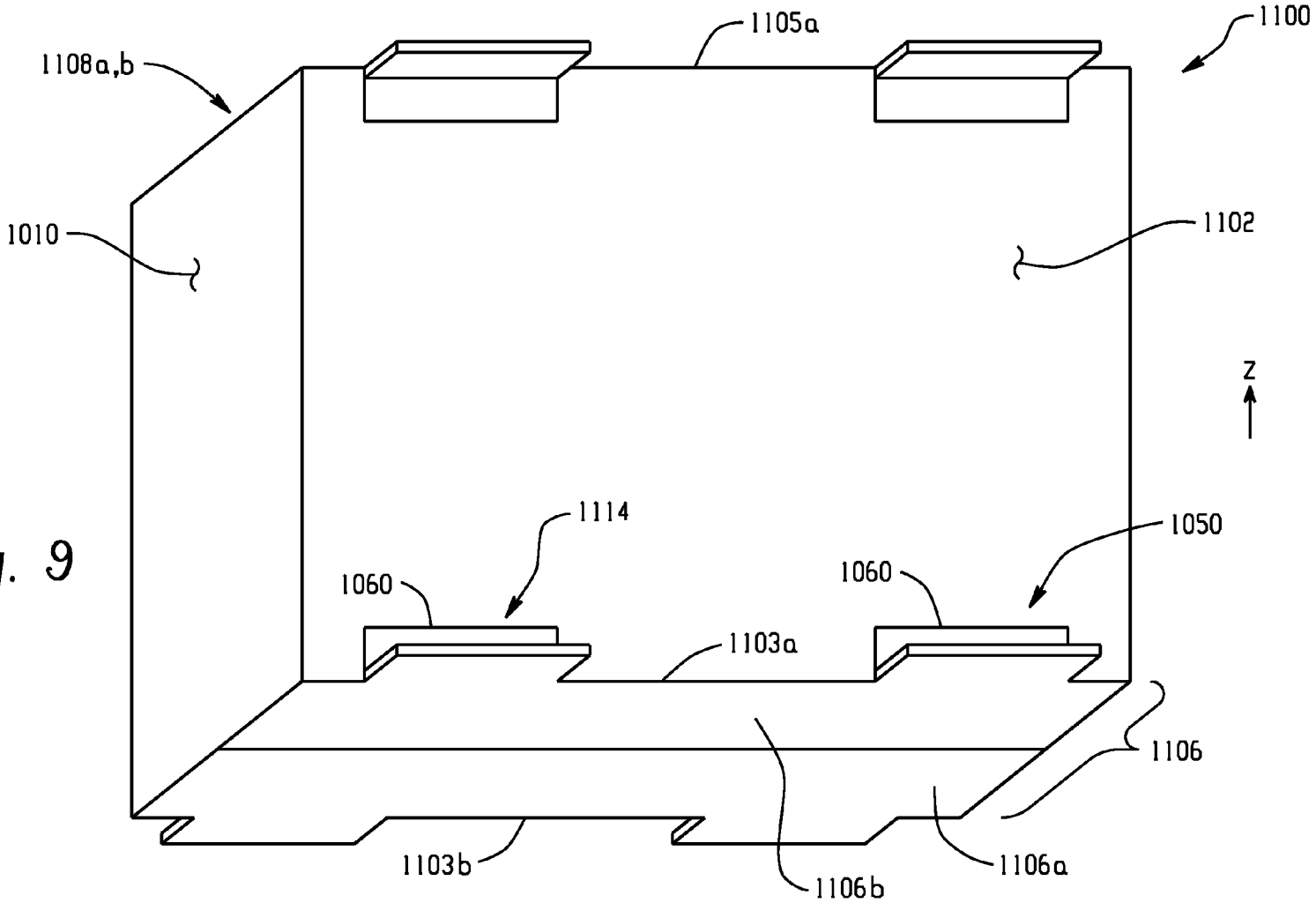
FIG. 9 illustrates a perspective view of an assembled packing container alternative to that of FIG. 3, in accordance with an embodiment of the invention.

With reference now to FIGS. 9, 10 and 11A-C, an embodiment includes a container 1100 having symmetrical top and bottom panels 1108, 1106 (refer to the discussion of FIG. 1 above regarding symmetrical and asymmetrical panels) having CRFs 1114 defined by recesses 1050 similar to that discussed above in connection with FIGS. 2-5 and 6 disposed proximate fold lines 1103, 1105 in the length-wise side panels 1102, 1104 (side panel 1104 hidden from view in FIG. 9). As discussed in connection with FIG. 6, the recesses 1050 have planar edges 1060 formed by a cut line 1020 (see FIGS. 11A-C) through the panel 1102, that are oriented orthogonal to the planar surface of side panel 1102 and perpendicular to the z-axis (see also FIG. 1). With reference back to FIG. 6, the planar edge 1060 is disposed a distance "d" away from the fold line 1103 but at a distance no greater than half a thickness of the panel 1102. As a result, the panel 1102 has a void or recess 1050 between the fold line 1103 and the planar edge 1060. In an embodiment, the distance d creating the recess 1050 equates to 3/32 of an inch. As mentioned previously, FIG. 6 includes a z-axis reference to indicate the orientation of the compression reinforcement feature 1114 and planar edge 1060 relative to a compressive load that would be applied to the container 1100 during stacking.

As a side note, when referring to the height of the tabs of CRFs 214 discussed above, reference may be made herein to a positive dimension, such as +3/32 of an inch, to indicate the presence of side panel material forming the tab, and when referring to the distance d of recess 1050, reference may be made herein to a negative dimension, such as −3/32 of an inch, to indicate the absence of side panel material forming the recess.

Figure 11A:
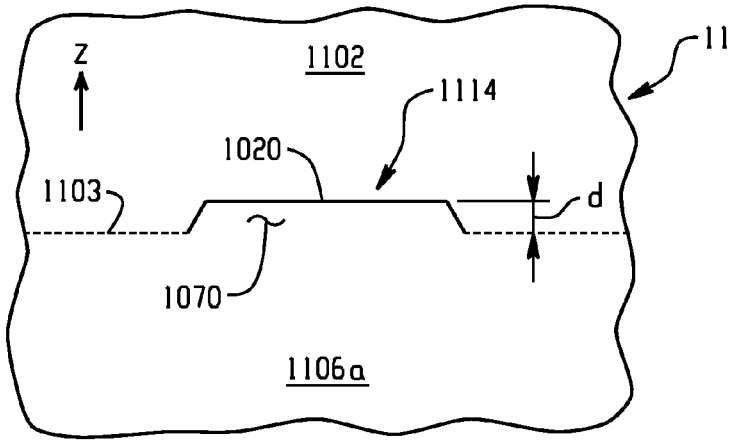
FIGS. 11A, B and C illustrate alternative arrangements to form a compression reinforcement feature in accordance with an embodiment of the invention.

With reference to FIG. 11A, the cut line 1020 can be seen extending into the side panel 1102 a distance "d" from the fold line 1103, which forms a tab 1070 made from material in the side panel 1102. By referring to FIG. 6, it is noteworthy that the tab 1070 extends in a direction orthogonal to the z-axis when the panels 1102, 1106*a* of container 1100 are folded, which is in a different direction as compared to the tabs of CRFs 214 discussed above. In an embodiment, the ends of cut line 1020 terminate at the fold line 1103.

Figure 11B:
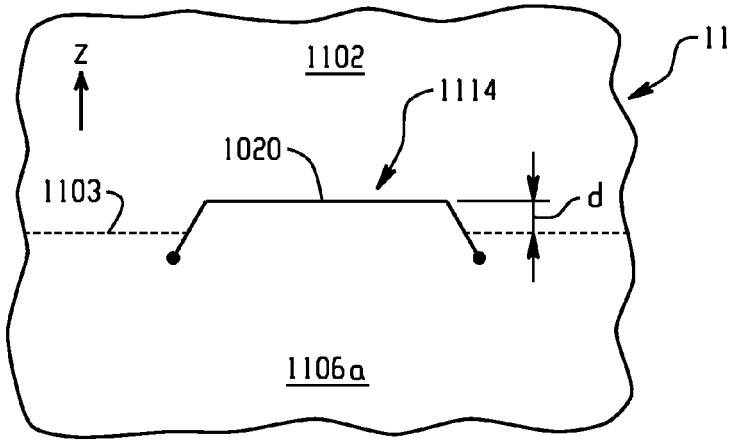

In another embodiment, and with reference to FIG. 11B, the ends of cut line 1020 terminate on the bottom panel 1106*a*. That is, the compression reinforcement feature 1114 is formed by a cut line 1020 that begins at a first point on the bottom panel 1106*a*, traverses a first distance along a first line that extends across the fold line 1103, traverses a second distance along a second line that runs substantially parallel to the fold line 1103, and traverses a third distance along a third line that extends back across the fold line 1103 to end at a second point on the bottom panel 1106*a*, wherein the second line defines a location of the planar edge 1060 of the compression reinforcement feature 1114. As with the embodiment of FIG. 11A, the cut line 1020 can be seen extending into the side panel 1102 a distance "d" from the fold line 1103, which in an embodiment is no greater than half the thickness of the side panel 1102.

Figure 11C:
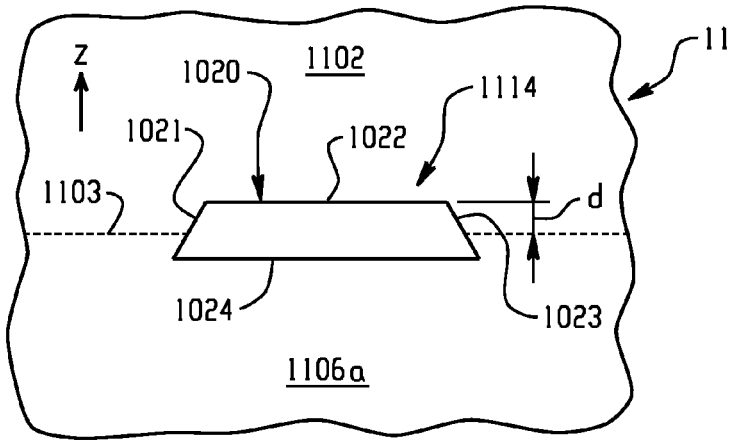

In another embodiment, and with reference to FIG. 11C, the compression reinforcement feature 1114 is formed by a cut line 1020 that begins at a first point on the bottom panel 1106*a*, traverses a first distance along a first cut line 1021 that extends across the fold line 1103, traverses a second distance along a second cut line 1022 that runs substantially parallel to the fold line 1103, traverses a third distance along a third cut line 1023 that extends back across the fold line 1103, and traverses a fourth distance along a fourth cut line 1024 that ends at the first point on the bottom panel 1106*a*, wherein the first, second, third and fourth cut lines define a closed perimeter of a cutout, and wherein the second cut line 1022 defines a location of the planar edge 1060 (see FIGS. 6 and 9) of the compression reinforcement feature 1114. As with the embodiment of FIGS. 11A and 11B, the cut line 1020 can be seen extending into the side panel 1102 a distance "d" from the fold line 1103, which in an embodiment is no greater than half the thickness of the side panel 1102. The fourth cut line 1024 may be straight, curved, or formed from a plurality of connected cut lines.

While FIGS. 11A-C each depict a cut line 1020 illustrated with a defined number of lines, such as three lines in FIGS. 11A and B, and four lines in FIG. 11C, it will be appreciated that each of the cut lines 1020 may include more than the number of illustrated lines as long as the resulting cut line serves a purpose disclosed herein.

Figure 10:
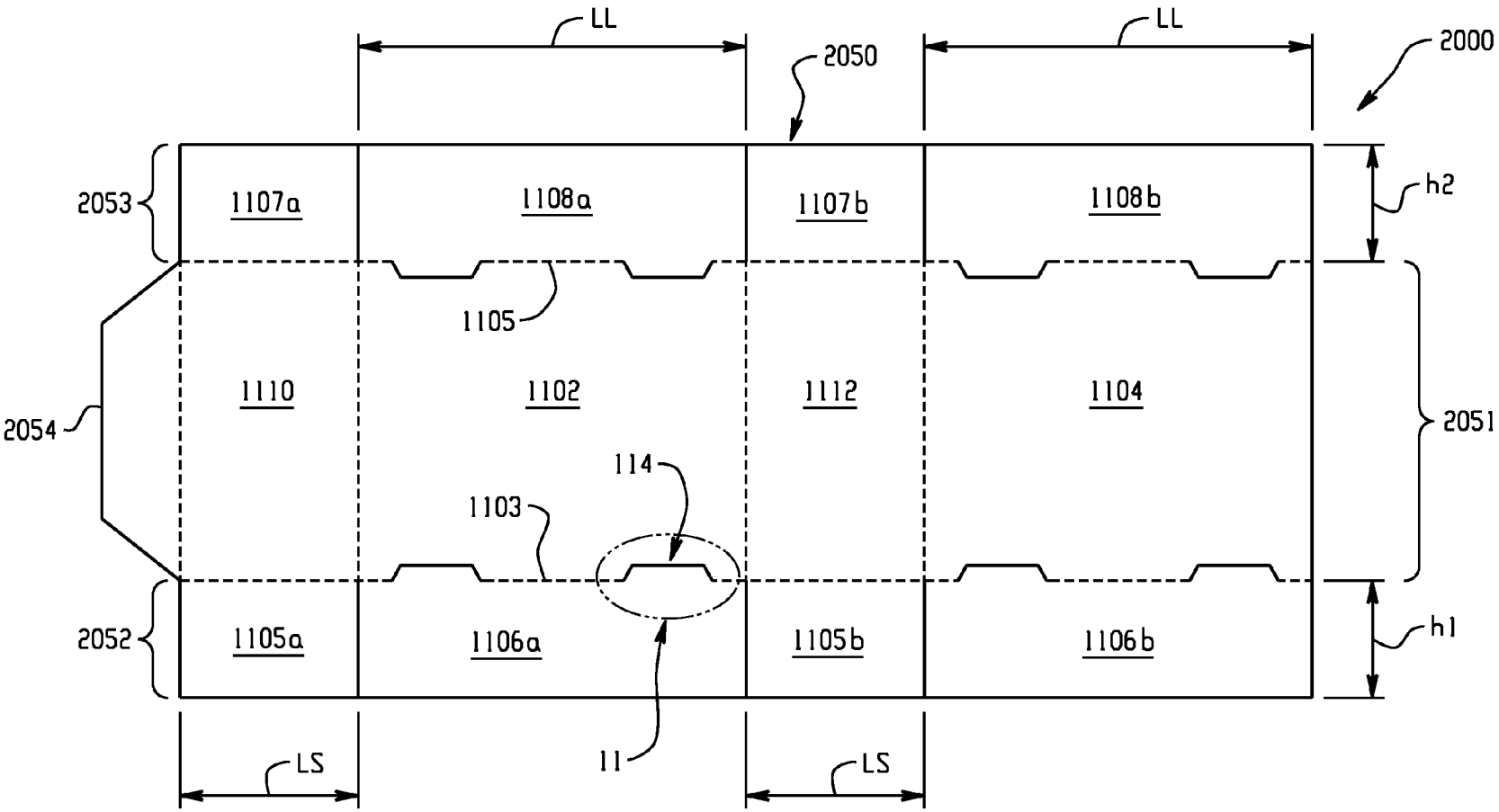
FIG. 10 illustrates a flat blank for the container of FIG. 9, in accordance with an embodiment of the invention.

Referring to FIG. 10, an embodiment of the container 1100 is formed from a flat blank 2000 having a plurality of panels 2050 that fold to form a regular slotted container (RSC) 1100 having four lateral panels (that is, four side panels). While embodiments described herein refer to containers having four lateral panels, it will be appreciated that the scope of the invention is not limited to containers having only four lateral panels, but also encompasses containers having another number of lateral panels, such as three, four, five, six, seven, eight, nine or ten lateral panels, for example. As illustrated in FIG. 10, CRFs 1114 may be arranged on either or both fold lines 1103, 1105 of the flat blank 2000, and may be in any quantity that serves a purpose disclosed herein.

With reference to FIGS. 9-10 in addition to FIG. 1, the plurality of panels 2050 includes a first panel 1102 having a first planar surface, and a second panel 1108*a* having a second planar surface, wherein the first panel 1102 and the second panel 1108*a* form a contiguity with a fold line 1105 disposed therebetween. In a folded state, the first planar surface of the first panel 1102 is disposed parallel to the x-z plane or the y-z plane (refer to FIG. 1 for illustration of x, y, z axes), and the second planar surface of the second panel 1108*a* is folded about fold line 1119 and disposed orthogonal to the first panel 1102.

In the embodiment of FIG. 10, the plurality of panels 2050 are so arranged as to form a regular slotted container (RSC) 1100 when folded. For example, the plurality of panels 2050 are arranged to form a plurality of central panels 2051, a plurality of first outboard panels 2052, a plurality of second outboard panels 2053, and at least one end panel 2054. The plurality of central panels 2051 defines major central panels 1102, 1104, and minor central panels 1110, 1112. The plurality of first and second outboard panels 2052, 2053, respectively define major outboard panels 1106*a,b* and 1108*a,b* that oppose each other, and minor outboard panels 1105*a,b* and 1107*a,b* that oppose each other. As depicted, each of the plurality of first and second outboard panels 2052, 2053 is disposed with respect to one of the plurality of central panels 2051 with a fold line 1103, 1105 disposed therebetween. Each of the plurality of first and second outboard panels 2052, 2053 have respective perpendicular dimensions "h1" and "h2" from the respective fold line 1103, 1105 to an outer edge of the respective outboard panel 2052, 2053, where "h1" may be equal to, greater than, or less than "h2". In an embodiment, the opposing major outboard panels 1106*a*, 1108*a* and 1106*b*, 1108*b* meet in a middle of the RSC 1100 when folded (see FIG. 9), and the opposing minor outboard panels 1105*a*, 1107*a* and 1105*b*, 1107*b* do not meet in the middle of the RSC 1100 when folded. In an embodiment, each of the major outboard panels 1106*a,b* and 1108*a,b* have a length "LL" that is longer than a length "LS" of each of the minor outboard panels 1105*a,b* and 1107*a,b*. While FIG. 10 depicts a plurality of panels 2050 that are foldable to form a non-square RSC 1100 having a length "LL" and a width "LS", where "LL" is greater than "LS", it will be appreciated that the scope of the invention is not so limited, and also encompasses a container 1100 having a length "LL" that equals its width "LS", such as in a square container 1100. It will also be appreciated that the heights "h1" and "h2" of the outboard panels 2052, 2053 may be sized such that some or none of the outboard panels 2052, 2053 meet in the middle of the RSC 1100 when folded.

As discussed above, CRFs 214, 1114 may be located on upper and/or lower edges (relative to the z-axis depicted in FIG. 1) of container 100, 1100, may be more advantageously located on edges of major central panels 1102, 1104, and may be in any quantity suitable for a purpose disclosed herein. In an embodiment, and with reference to container 100 depicted in FIG. 3, two CRFs 214 are disposed on the upper edge 123 proximate opposing ends of the container 100, and a pair of CRFs 1114 are each disposed on respective lower edges 103, 105, however, in another embodiment CRFs 1114 may be omitted. In an embodiment, and with reference to container 1100 depicted in FIG. 9, a pair of CRFs 1114 are each disposed on respective lower edges 1103*a,b*, and a pair of CRFs 1114 are each disposed on respective upper edges 1105*a,b*, however, in another embodiment the upper or lower four CRFs 1114 may be omitted.

Figure 12:
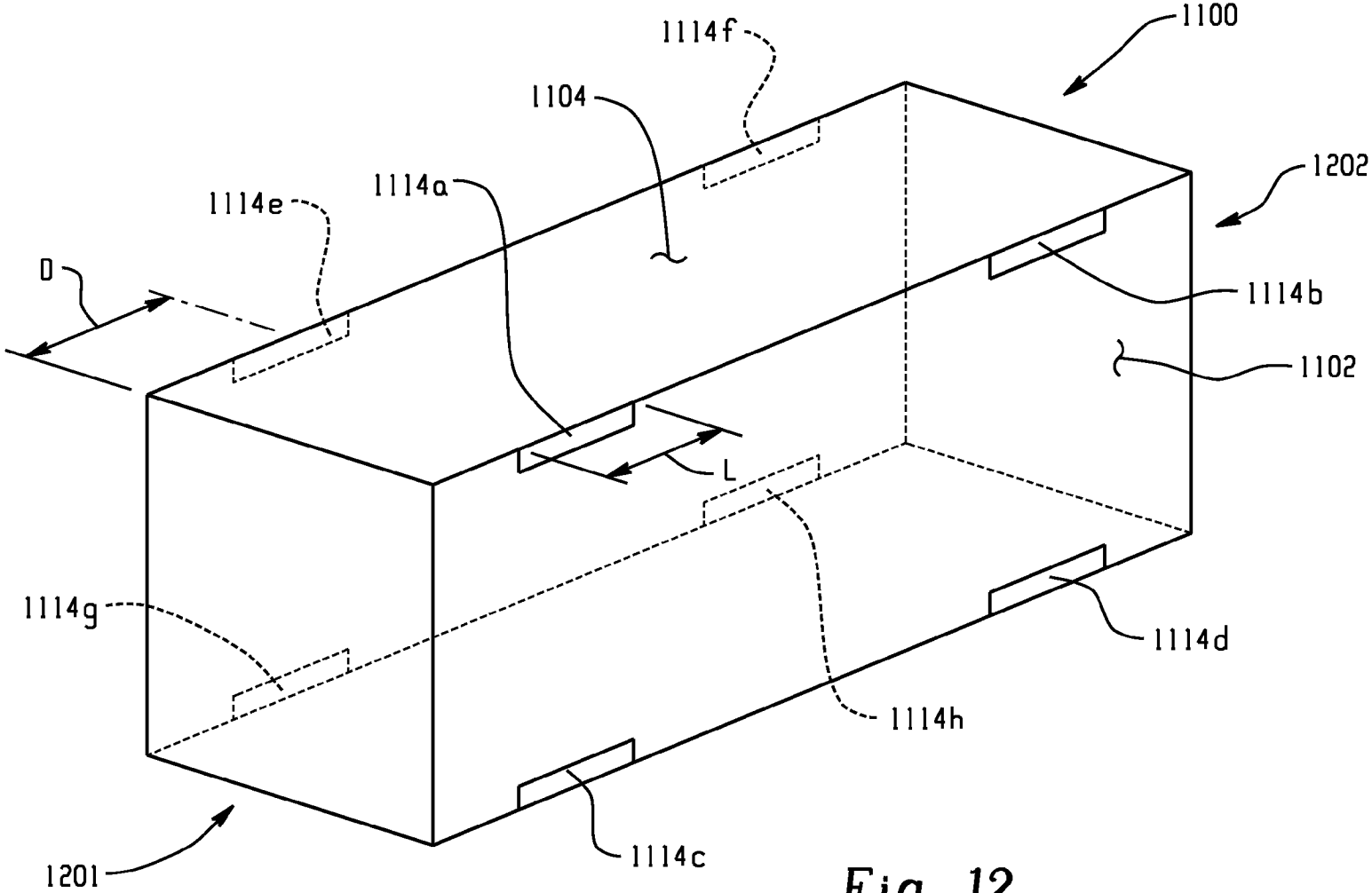
FIG. 12 illustrates a perspective view of a container having a plurality of compression reinforcement features, in accordance with an embodiment of the invention.

In an embodiment, and with reference to FIG. 12, side panels 1102 and/or 1104 include compression reinforcement features 1114 *a, b, c, d, e, f, g*, and *h*. While FIG. 12 illustrates side panel 1102 having compression reinforcement features 1114 *a, b, c, d*, and side panel 1104 having compression reinforcement features 1114 *e, f, g, h*, it will be appreciated that the scope of the invention is not so limited and also encompasses other quantities, more or less, of compression reinforcement features 1114 disposed in a manner consistent with a purpose disclosed herein.

In an embodiment, compression reinforcement features 1114 *a, b, c, d, e, f, g*, and *h*, are arranged in pairs along respective edges of container 1100 as illustrated in FIG. 12, with a first compression reinforcement feature of the pair, 1114*a* for example, being disposed proximate a first end 1201 of the side panel 1102 of container 1100, and a second compression reinforcement feature of the pair, 1114*b* for example, being disposed proximate a second end 1202 of the side panel 1102 of the container 1100. In an embodiment, a centerline of the first compression reinforcement feature 1114*a* is disposed at a distance from the first end 1201 of the first panel 1102 that is equal to or less than 40% of a length "LL" of the first panel 1102 (see FIG. 10 for length "LL"). In another embodiment, a centerline of the second compression reinforcement feature 1114*b* is disposed at a distance from the second end 1202 of the first panel 1102 that is equal to or less than 40% of the length "LL" of the first panel 1102. In an embodiment, a centerline of the first compression reinforcement feature 1114*a* is disposed at a distance from the first end 1201 of the first panel 1102 that is equal to or less than 25% of a length "LL" of the first panel 1102. In an embodiment, a centerline of the second compression reinforcement feature 1114*b* is disposed at a distance from the second end 1202 of the first panel 1102 that is equal to or less than 25% of the length "LL" of the first panel 1102. In an embodiment, the compression reinforcement feature 1114*a* and the compression reinforcement feature 1114*c* are disposed equidistant from a same end 1201 of the first panel 1102. In an embodiment, any one of compression reinforcement features 1114*a, b, c, d, e, f, g, h*, has a length "L" that is from 10% to 30% of a length "LL" of the first panel 1102. In an embodiment, any one of compression reinforcement features 1114*a, b, c, d, e, f, g, h*, has a length "L" that is from 10% to 20% of a length "LL" of the first panel 1102. In an embodiment, the plurality of panels of container 100, 1100 form a box having four lateral sides, which in an embodiment has a length dimension (in a direction parallel to the y-axis) from 14 inches to 33 inches, has a width dimension (in a direction parallel to the x-axis) from 8 inches to 14 inches, and has a height dimension (in a direction parallel to the z-axis) from 6 inches to 16 inches.

While reference is made herein to a container 100, 1100 having certain overall dimensions, it will be appreciated that such noted dimensions are merely to establish an order of magnitude and not to be construed as being exact. For example, a container formed in accordance with an embodiment of the invention may fall anywhere within the dimensional window having a minimum envelope size defined by a 5-inch cube, and a maximum envelope size defined by a 50-inch cube, where the container may or may not be a cube.

In view of the foregoing, it will be appreciated that an embodiment of the invention includes a container 100, 1100 having a plurality of panels that includes a first side panel, a second side panel, a first end panel, and second end panel, a top panel and a bottom panel, the plurality of panels being integrally arranged with respect to each other to form a box having four lateral sides and configured to support a stacking load when exerted in a z-direction from the top panel toward the bottom panel. Wherein the first side panel and a first portion of the top panel form a contiguity with a first fold line disposed therebetween. Wherein the second side panel and a second portion of the top panel form a contiguity with a second fold line disposed therebetween. Wherein a first compression reinforcement feature is disposed proximate the first fold line and proximate the first end panel. Wherein a second compression reinforcement feature disposed proximate the first fold line and proximate the second end panel. Wherein a third compression reinforcement feature disposed proximate the second fold line and proximate the first end panel. Wherein a fourth compression reinforcement feature disposed proximate the second fold line and proximate the second end panel. Wherein each of the first and second compression reinforcement features have a planar edge oriented orthogonal to the first side panel and perpendicular to the z-direction, each respective planar edge being disposed a distance away from the first fold line but at a distance no greater than half a thickness of the first panel, the first panel having a void between the first fold line and each respective planar edge. Wherein each of the third and fourth compression reinforcement features have a planar edge oriented orthogonal to the second side panel and perpendicular to the z-direction, each respective planar edge being disposed a distance away from the second fold line but at a distance no greater than half a thickness of the second panel, the second panel having a void between the second fold line and each respective planar edge.

Through substantial experimentation, discussed further below, it has be found that CRF's 214 (tabs) are advantageous on such a container as depicted in FIGS. 3, 4 and 5, that is, a container 100 having an overlapped top panel 108, and that CRFs 1114 (recesses) are advantageous on such a container as depicted in FIGS. 6, 9 and 10, that is, a container 1100 having non-overlapping top and/or bottom panels 1108*a,b* and 1106*a,b*, respectively.

It will be appreciated that a compression strength of a container could be dependent upon many variables associated with the container, such as a length, a width, a height of the container, the material forming the container, the type of fluting of fluted material forming the container, and the thickness of material forming the container, for example. Also, and in the case of the container having one or more of the aforementioned compression reinforcement features, the compression strength of the container could be dependent upon a length of the compression reinforcement feature, placement of the compression reinforcement feature, a height dimension (plus or minus) of the compression reinforcement feature, and a quantity of the compression reinforcement features. Through the use of exhaustive design of experiment (DOE) modeling, the following has been found.

With reference now to FIG. 13, Table-1 provides DOE box compression test (BCT) scaled estimates for a container made from lightweight fluted containerboard having B-flute and a minimum edgewise compression test specification of 32 lbs/inch. Column-1 labeled "Term" provides a listing of 23 parameters used in this DOE, plus the first entry labeled "Intercept", which is the value in pounds from which all other parameters are scaled (plus or minus). Column-2 labeled "Scaled Estimates" is the value in pounds resulting from the DOE. Column-3 provides a graphical representation of the content of Column-2. Column-4 labeled "Prob>|t|" indicates the probability that a particular parameter is statistically significant or not with respect to the DOE results.

With reference now to FIG. 14, Table-2 provides DOE BCT scaled estimates similar to those of Table-1, but for a container made from heavyweight fluted containerboard having C-flute and a minimum edgewise compression test specification of 44 lbs/inch.

With reference now to FIG. 15, Table-3 provides DOE BCT scaled estimates similar to those of Tables-1 and 2, except that it combines the data from Tables-1 and 2, hence the additional entries of "Board Combination [44C]" and "Board Combination [32B]" in Column-1.

Referring to Table-1 as an example, a container 1100 having a CRF 1114 as discussed above disposed on a length-wise edge 1103 of the container 1100 (see Column-1 parameter labeled "Tab Height-Length Panel [−½ caliper]"), has a DOE BCT result that is +29.397971 pounds stronger than the normalized intercept value. However, it is not only the scaled estimates that are of interest, but also the probability of statistical significance that is presented in Column-4, which in this example has a value of 0.0015. For DOE's it is accepted practice that if a level of significance for an estimated parameter is equal to or greater than 95% probability, then the results of that parameter is considered to be statistically significant. With respect to Column-4, equal to or greater than 95% probability equates to a "Prob>|t|" value of equal to or less than 0.05. As such, the subject CRF 1114 with a ½ caliper recess has a probability of being statistically significant in improving the compression strength of the container 1100.

By referring to Tables-1, 2 and 3 in combination, several parameters show up as being statistically significant in improving the compression strength of a container. However, for a given container size one of the aforementioned parameters consistently shows up as being statistically significant, which is the parameter in each Column-1 labeled "Tab Height-Length Panel [−½ caliper]". This parameter correlates with the CRF 1114 discussed above in connection with FIGS. 6, 9 and 10, where the "[−½ caliper]" relates to the dimension of a recess having a "d" dimension of 3⁄32 of an inch.

It is noteworthy, however, to also consider parameters that appear to have statistical significance in one or more, but not all, of Tables-1, 2 and 3. For example, the parameter labeled "Corner Space [At corner]" has equal to or greater than 95% probability of being advantageously statistically significant in Tables-1 and 3, and the parameter labeled "Tab Length [20%]" has equal to or greater than 95% probability of being advantageously statistically significant in Table-3.

The parameter labeled "Corner Space [At corner]" refers to a CRF 214, 1114 that is located closer to a corner of the container than to a center region of the container, and the parameter labeled "Tab Length [20%]" refers to a CRF 214, 1114 having a length that is 20% of the length of the edge of the container on which it is located, both of which will now be discussed further with reference back to FIG. 12.

With reference to FIG. 12, a RSC 1100 having length, width and height dimensions of 15 inches×inches×6.25 inches, respectively, underwent box compression tests with CRFs 1114*a, b, c, d, e, f, g, h* having varied lengths and having varied locations along an edge of the container.

A first set of test results showed that the RSC 1100 had improved compression strength when the centers of the CRFs were placed a distance of 3.5 inches from the end of the container, versus being placed substantially at the end of the container, and versus being placed 5.5 inches from the end of the container. However, all three placements showed an improvement in compression strength over a baseline RSC 1100 having no CRFs at all, the most advantageous placement (centerline at 3.5 inches from container end) had an improvement of 11%.

A second set of test results showed that the RSC 1100 had improved compression strength when the length of the CRFs were 20-30% of the edge length of the RSC (on a lengthwise side of the RSC), versus being 10% or 40%. However, all four lengths showed an improvement in compression strength over a baseline RSC 1100 having no CRFs at all. While the most advantageous length was 30%, having an improvement over the baseline RSC of 12.5%, an 11.2% improvement was found for a 20% length, a 4.4% improvement for a 10% length, and a 3.6% improvement for a 40% length.

From all of the foregoing substantive DOE's and empirical tests, it was found that two types of CRFs 214 (tabs) and 1114 (recesses) can be advantageous in improving the compressive strength of a respective container 100 and 1100, when strategically used and placed as disclosed herein.

For a container 100, such as an overlapped container as depicted in FIGS. 3, 4 and 5, CRFs 214 having a tab height, relative to the outer surface of panel 1108', of half a thickness of the side panel 104 forming the container 100 have been found to be advantageous, while for a container 1100, such as a slotted container or a regular slotted container as depicted in FIGS. 6, 9 and 10, CRFs 1114 having a recess dimension "d" of half a thickness of the side panel forming the container has been found to be advantageous. For a container formed from containerboard having a C-flute, the half-thickness dimension equates to about 3⁄32 of an inch.

For either the container 100 or the container 1100, respective CRFs 214, 1114 having a length of 10-30% of the length of the container have been found to be advantageous, and respective CRFs 214, 1114 having a respective centerline located at a distance from the end of the container that is between 25-40% of the length of the container have been found to be advantageous.

For the container 100, placing CRFs 214 only on one edge, the edge proximate the glued overlap as depicted in FIG. 3, has been found to be advantageous, while for the container 1100, placing CRFs 1114 on any opposing edges, as depicted in FIG. 9, has been found to be advantageous. While not being held to any particular theory, it is contemplated that the difference between single-edge reinforcement, such as using a CRF 214 in the form of a "tab", versus two-edge reinforcement, such as using a CRF 1114 in the form of a "recess", is a result of improving uniform stress distribution across the surfaces of the respective container during compressive loading.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A container, comprising:

a plurality of panels integrally arranged with respect to each other and with respect to a set of orthogonal x, y and z axes, the z-axis defining a direction line in which the container is configured to support a stacking load;

wherein the plurality of panels comprise a first panel comprising a first planar surface, and a second panel comprising a second planar surface, wherein the first panel and the second panel form a contiguity with a fold line disposed therebetween, wherein the first planar surface is disposed parallel to the x-z plane or the y-z plane; and a compression reinforcement feature having a planar edge oriented orthogonal to the first planar surface and perpendicular to the z-axis, the planar edge being disposed a distance away from the fold line but at a distance no greater than half a thickness of the first panel, the first panel comprising a void between the fold line and the planar edge;

wherein the second panel comprises a tab that is a continuous extension of and coplanar with the second panel, and extends beyond the fold line parallel to and in face-to-face relationship with the planar edge, wherein the tab extends no further than an outside surface of the first panel.

2. The container of claim 1, wherein:

the plurality of panels are so arranged as to form a slotted container (SC) when folded;

the plurality of panels are arranged to form a plurality of central panels, a plurality of first outboard panels, a plurality of second outboard panels, and at least one end panel, the plurality of first and second outboard panels respectively defining major outboard panels that oppose each other and minor outboard panels that oppose each other;

each of the plurality of first and second outboard panels is disposed with respect to one of the plurality of central panels with a fold line disposed therebetween;

each of the plurality of first and second outboard panels has a perpendicular dimension from the respective fold line to an outer edge of the respective outboard panel; and the opposing major outboard panels comprise edges that face each other when the SC is folded, and the opposing minor outboard panels comprise edges that face each other when the SC is folded.

3. The container of claim 1, wherein:

the plurality of panels are so arranged as to form a die cut container (DCC) when folded.

4. The container of claim 1, wherein:

the planar edge is disposed a distance away from the fold line at a distance no greater than 3/32 of an inch.

5. The container of claim 1, wherein:

the compression reinforcement feature is formed by a cut line that begins at a first point on the second panel, traverses a first distance along a first line that extends across the fold line, traverses a second distance along a second line that runs substantially parallel to the fold line, and traverses a third distance along a third line that extends back across the fold line to end at a second point, wherein the second line defines a location of the planar edge of the compression reinforcement feature.

6. The container of claim 1, wherein the second planar surface is disposed orthogonal to the first planar surface.

7. The container of claim 1, wherein the plurality of panels is made from corrugated material.

8. The container of claim 7, wherein the corrugated material comprises A-flute, B-flute, C-flute, E-flute, F-flute, or microflute.

9. The container of claim 1, wherein:

the plurality of panels are arranged to form a plurality of central panels, a plurality of first outboard panels, and a plurality of second outboard panels, the plurality of first and second outboard panels respectively defining major outboard panels that oppose each other and minor outboard panels that oppose each other, each of the major outboard panels having a length that is longer than a length of each of the minor outboard panels;

each of the plurality of first and second outboard panels is disposed with respect to one of the plurality of central panels with a fold line disposed therebetween;

the second panel is a major outboard panel; and the first panel is a central panel contiguous with the second panel with a respective fold line disposed therebetween.

10. The container of claim 1, wherein:

the first panel comprises a first and a second of the compression reinforcement feature.

11. The container of claim 10, wherein:

the first compression reinforcement feature is disposed proximate a first end of the first panel, and the second compression reinforcement feature is disposed proximate a second opposing end of the first panel.

12. The container of claim 11, wherein:

a center of the first compression reinforcement feature is disposed at a distance from the first end of the first panel that is equal to or less than 40% of a length of the first panel; and a center of the second compression reinforcement feature is disposed at a distance from the second end of the first panel that is equal to or less than 40% of the length of the first panel.

13. The container of claim 11, wherein:

a center of the first compression reinforcement feature is disposed at a distance from the first end of the first panel that is equal to or less than 25% of a length of the first panel; and a center of the second compression reinforcement feature is disposed at a distance from the second end of the first panel that is equal to or less than 25% of the length of the first panel.

14. The container of claim 1, wherein:

the compression reinforcement feature has a length that is from 10% to 30% of a length of the first panel.

15. The container of claim 1, wherein:

the compression reinforcement feature has a length that is from 10% to 20% of a length of the first panel.

16. The container of claim 1, wherein:

the plurality of panels forms a box having four lateral sides.

17. The container of claim 16, wherein:

the box has a length dimension from 14 inches to 33 inches, has a width dimension from 8 inches to 14 inches, and has a height dimension from 6 inches to 16 inches.

18. The container of claim 1, wherein:

the compression reinforcement feature defines a first compression reinforcement feature;

the plurality of panels further comprises a third panel;

the first panel and the third panel form a contiguity with a second fold line disposed therebetween; and a second compression reinforcement feature comprises a second planar edge oriented orthogonal to the first planar surface and perpendicular to the z-axis, the second planar edge being disposed a distance away from the second fold line but at a distance no greater than half a thickness of the first panel, the first panel comprising a void between the second fold line and the second planar edge.

19. The container of claim 18, wherein:

the first compression reinforcement feature and the second compression reinforcement feature are disposed equidistant from a same end of the first panel.

20. The container of claim 1, wherein the plurality of panels are formed from a sheet product of natural cloth or paper, synthetic cloth or paper, or a combination of natural and synthetic cloth or paper.

21. The container of claim 20, wherein the sheet product comprises corrugated fiber board.

22. A container, comprising:

a plurality of panels comprising a first side panel, a second side panel, a first end panel, and second end panel, a top panel and a bottom panel, the plurality of panels being integrally arranged with respect to each other to form a box having four lateral sides configured to support a stacking load when exerted in a z-direction from the top panel toward the bottom panel;

wherein the first side panel and a first portion of the top panel form a contiguity with a first fold line disposed therebetween;

wherein the second side panel and a second portion of the top panel form a contiguity with a second fold line disposed therebetween;

a first compression reinforcement feature disposed proximate the first fold line and proximate the first end panel;

a second compression reinforcement feature disposed proximate the first fold line and proximate the second end panel;

a third compression reinforcement feature disposed proximate the second fold line and proximate the first end panel;

a fourth compression reinforcement feature disposed proximate the second fold line and proximate the second end panel;

each of the first and second compression reinforcement features having a planar edge oriented orthogonal to the first side panel and perpendicular to the z-direction, each respective planar edge being disposed a distance away from the first fold line but at a distance no greater than half a thickness of the first side panel, the first side panel comprising a void between the first fold line and each respective planar edge;

wherein the first portion of the top panel proximate each of the first and second compression reinforcement features comprises a tab, each tab is a continuous extension of and coplanar with the first portion of the top panel, and extends beyond the first fold line parallel to and in face-to-face relationship with the respective planar edge of the first and second compression reinforcement features, wherein each respective tab extends no further than an outside surface of the first side panel;

each of the third and fourth compression reinforcement features having a planar edge oriented orthogonal to the second side panel and perpendicular to the z-direction, each respective planar edge being disposed a distance away from the second fold line but at a distance no greater than half a thickness of the second side panel, the second side panel comprising a void between the second fold line and each respective planar edge;

wherein the second portion of the top panel proximate each of the third and fourth compression reinforcement features comprises a tab, each tab is a continuous extension of and coplanar with the second portion of the top panel, and extends beyond the second fold line parallel to and in face-to-face relationship with the respective planar edge of the third and fourth compression reinforcement features, wherein each respective tab extends no further than an outside surface of the second side panel.

23. A container, comprising:

a plurality of panels integrally arranged with respect to each other and with respect to a set of orthogonal x, y and z axes, the z-axis defining a direction line in which the container is configured to support a stacking load;

wherein the plurality of panels comprise a first panel comprising a first planar surface, and a second panel comprising a second planar surface, wherein the first panel and the second panel form a contiguity with a fold line disposed therebetween, wherein the first planar surface is disposed parallel to the x-z plane or the y-z plane; wherein the second panel is disposed orthogonal to the first panel; and a compression reinforcement feature having a planar edge oriented orthogonal to the first planar surface and perpendicular to the z-axis, the compression reinforcement feature comprising a tab that extends from and is coplanar with the first panel and that terminates at the planar edge, the planar edge being disposed a distance away from a planar outer surface of the second panel but at a distance no greater than half a thickness of the first panel;

wherein the plurality of panels further comprises a third panel adhered to the outer surface of the second panel proximate the tab;

wherein the second panel comprises a planar edge disposed parallel to the first planar surface and in face-to-face relationship with the tab, wherein the planar edge of the tab extends no further than an outside surface of the third panel.

24. The container of claim 23, wherein:

the planar edge is disposed a distance away from the outer surface of the second panel but at a distance no greater than 3/32 of an inch.

25. The container of claim 23, wherein:

the compression reinforcement feature is formed by a cut line that begins at a first point on the first panel, traverses a first distance along a first line that extends across the fold line, traverses a second distance along a second line that runs substantially parallel to the fold line, and traverses a third distance along a third line that extends back across the fold line to end at a second point, wherein the second line defines a location of the planar edge of the compression reinforcement feature.

26. The container of claim 23, wherein the second planar surface is disposed orthogonal to the first planar surface.

27. The container of claim 23, wherein the plurality of panels is made from corrugated material.

28. The container of claim 27, wherein the corrugated material comprises A-flute, B-flute, C-flute, E-flute, F-flute, or microflute.

29. The container of claim 23, wherein:

the first panel comprises a first and a second of the compression reinforcement feature.

30. The container of claim 29, wherein:

the first compression reinforcement feature is disposed proximate a first end of the first panel, and the second compression reinforcement feature is disposed proximate a second opposing end of the first panel.

31. The container of claim 30, wherein:

a center of the first compression reinforcement feature is disposed at a distance from the first end of the first panel that is equal to or less than 40% of a length of the first panel; and a center of the second compression reinforcement feature is disposed at a distance from the second end of the first panel that is equal to or less than 40% of the length of the first panel.

32. The container of claim 30, wherein:

a center of the first compression reinforcement feature is disposed at a distance from the first end of the first panel that is equal to or less than 25% of a length of the first panel; and a center of the second compression reinforcement feature is disposed at a distance from the second end of the first panel that is equal to or less than 25% of the length of the first panel.

33. The container of claim 23, wherein:

the compression reinforcement feature has a length that is from 10% to 30% of a length of the first panel.

34. The container of claim 23, wherein:

the compression reinforcement feature has a length that is from 10% to 20% of a length of the first panel.

35. The container of claim 23, wherein:

the plurality of panels forms a box having four lateral sides.

36. The container of claim 35, wherein:

the box has a length dimension from 14 inches to 33 inches, has a width dimension from 8 inches to 14 inches, and has a height dimension from 6 inches to 16 inches.

37. The container of claim 23, wherein:

the compression reinforcement feature defines a first compression reinforcement feature;

the plurality of panels further comprises a fourth panel;

the first panel and the fourth panel form a contiguity with a second fold line disposed therebetween; and a second compression reinforcement feature comprises a second planar edge oriented orthogonal to the first planar surface and perpendicular to the z-axis, the second planar edge being disposed a distance away from the second fold line but at a distance no greater than half a thickness of the first panel, the first panel comprising a void between the second fold line and the second planar edge.

38. The container of claim 37, wherein:

the first compression reinforcement feature and the second compression reinforcement feature are disposed equidistant from a same end of the first panel.

39. A container, comprising:

a plurality of panels comprising a first side panel, a second side panel, a first end panel, and second end panel, a top panel and a bottom panel, the plurality of panels being integrally arranged with respect to each other to form a box having four lateral sides configured to support a stacking load when exerted in a z-direction from the top panel toward the bottom panel;

wherein the first side panel and a first portion of the top panel form a contiguity with a first fold line disposed therebetween;

wherein the first side panel and a first portion of the bottom panel form a contiguity with a second fold line disposed therebetween;

a first compression reinforcement feature disposed proximate the first fold line and proximate the first end panel;

a second compression reinforcement feature disposed proximate the first fold line and proximate the second end panel;

a third compression reinforcement feature disposed proximate the second fold line and proximate the first end panel;

a fourth compression reinforcement feature disposed proximate the second fold line and proximate the second end panel;

each of the first and second compression reinforcement features having a planar edge oriented orthogonal to the first side panel and perpendicular to the z-direction, each of the first and second compression reinforcement features comprising a tab that extends from and is coplanar with the first side panel and that terminates at a respective planar edge, each respective planar edge being disposed a distance away from an outer surface of the top panel but at a distance no greater than half a thickness of the first panel;

each of the third and fourth compression reinforcement features having a planar edge oriented orthogonal to the first side panel and perpendicular to the z-direction, each respective planar edge of the third and fourth compression reinforcement features being disposed a distance away from the second fold line but at a distance no greater than half a thickness of the first side panel, the first side panel comprising a void between the second fold line and each respective planar edge of the third and fourth compression reinforcement features;

wherein the first portion of the bottom panel proximate each of the third and fourth compression reinforcement features comprises a tab, each tab is a continuous extension of and coplanar with the first portion of the bottom panel, and extends beyond the second fold line parallel to and in face-to-face relationship with the respective planar edge of the third and fourth compression reinforcement features, wherein each respective tab extends no further than an outside surface of the first side panel.

40. A flat blank, comprising:

a first panel and a second panel that form a contiguity with a fold line disposed therebetween; and a compression reinforcement feature formed by a cut line that begins at a first point on the second panel, traverses a first distance along a first line that extends across the fold line, traverses a second distance along a second line that runs substantially parallel to the fold line, and traverses a third distance along a third line that extends back across the fold line to end at a second point on the second panel, wherein the second line defines a location of a planar edge of the compression reinforcement feature, wherein the planar edge is disposed a distance away from the fold line but at a distance no greater than half a thickness of the first panel;

wherein when the flat blank is folded at the fold line to orient the first panel perpendicular to the second panel, and the first panel parallel with a z-axis of a set of orthogonal x, y and z axes, the compression reinforcement feature has a planar edge oriented orthogonal to an outer surface of the first panel and perpendicular to the z-axis, the first panel comprising a void between the fold line and the planar edge, and the second panel comprising a tab that is a continuous extension of and coplanar with the second panel, and extends beyond the fold line parallel to and in face-to-face relationship with the planar edge, wherein the tab extends no further than an outside surface of the first panel.

41. The flat blank of claim 40, wherein the fold line is a first fold line, the compression reinforcement feature is a first compression reinforcement feature, the cut line is a first cut line, and the planar edge is a first planar edge, and further comprising:

a third panel, wherein the first panel and the third panel form a contiguity with a second fold line disposed therebetween; and a second compression reinforcement feature formed by a second cut line that begins at a first point on the third panel, traverses a fourth distance along a fourth line that extends across the second fold line, traverses a fifth distance along a fifth line that runs substantially parallel to the second fold line, and traverses a sixth distance along a sixth line that extends back across the second fold line to end at a second point on the third panel, wherein the fifth line defines a location of a second planar edge of the second compression reinforcement feature, wherein the second planar edge is disposed a distance away from the second fold line but at a distance no greater than half a thickness of the first panel.

42. The flat blank of claim 41, wherein:

the first cut line defines a boundary that forms a first tab that extends from and is coplanar with the second panel; and the second cut line defines a boundary that forms a second tab that is coextensive and coplanar with the third panel.

43. A flat blank, comprising:

a first panel and a second panel that form a contiguity with a fold line disposed therebetween; and a compression reinforcement feature formed by a cut line that begins at a first point on the first panel, traverses a first distance along a first line that extends across the fold line, traverses a second distance along a second line that runs substantially parallel to the fold line, and traverses a third distance along a third line that extends back across the fold line to end at a second point on the first panel, wherein the second line defines a location of a planar edge of the compression reinforcement feature, wherein the planar edge is disposed a distance away from the fold line but at a distance no greater than a full thickness of the first panel;

wherein when the flat blank is folded at the fold line to orient the first panel perpendicular to the second panel, and the second panel parallel with a z-axis of a set of orthogonal x, y and z axes, the compression reinforcement feature has a planar edge oriented orthogonal to an outer surface of the second panel and perpendicular to the z-axis, the second panel comprising a void between the fold line and the planar edge, and the first panel comprising a tab that is a continuous extension of and coplanar with the first panel, and extends beyond the fold line parallel to and in face-to-face relationship with the planar edge, wherein the tab extends no further than an outside surface of the second panel.

44. The flat blank of claim 43, wherein the fold line is a first fold line, the compression reinforcement feature is a first compression reinforcement feature, the cut line is a first cut line, and the planar edge is a first planar edge, and further comprising:

a third panel, wherein the first panel and the third panel form a contiguity with a second fold line disposed therebetween; and a second compression reinforcement feature formed by a second cut line that begins at a first point on the third panel, traverses a fourth distance along a fourth line that extends across the second fold line, traverses a fifth distance along a fifth line that runs substantially parallel to the second fold line, and traverses a sixth distance along a sixth line that extends back across the second fold line to end at a second point on the third panel, wherein the fifth line defines a location of a second planar edge of the second compression reinforcement feature, wherein the second planar edge is disposed a distance away from the second fold line but at a distance no greater than half a thickness of the first panel.

45. The flat blank of claim 44, wherein:

the first cut line defines a boundary that forms a first tab that is coextensive and coplanar with the first panel; and the second cut line defines a boundary that forms a second tab that is coextensive and coplanar with the third panel.

* * * * *